US009097482B1

(12) United States Patent
Holden et al.

(10) Patent No.: US 9,097,482 B1
(45) Date of Patent: Aug. 4, 2015

(54) SOUND SUPPRESSOR FOR A FIREARM

(71) Applicant: SILENCERCO, LLC, West Valley City, UT (US)

(72) Inventors: Harrison Holden, Sandy, UT (US); Casey Brandol, Salt Lake City, UT (US); Jonathon Shults, Sandy, UT (US)

(73) Assignee: SilencerCo LLC, West Valley City, UT (US)

( * ) Notice: Subject to any disclaimer, the term of this patent is extended or adjusted under 35 U.S.C. 154(b) by 0 days.

(21) Appl. No.: 14/444,221

(22) Filed: Jul. 28, 2014

Related U.S. Application Data

(63) Continuation-in-part of application No. 29/497,008, filed on Jul. 20, 2014, and a continuation-in-part of application No. 29/497,009, filed on Jul. 20, 2014, and a continuation-in-part of application No. 29/497,010, filed on Jul. 20, 2014.

(60) Provisional application No. 62/026,646, filed on Jul. 20, 2014.

(51) Int. Cl.
*F41A 21/30* (2006.01)
*F41A 21/00* (2006.01)

(52) U.S. Cl.
CPC ..... *F41A 21/30* (2013.01)

(58) Field of Classification Search
USPC ..... 181/223, 243, 270; 89/14.4, 14.3, 14.2
See application file for complete search history.

(56) References Cited

U.S. PATENT DOCUMENTS 825,010 A * 7/1906 Snow ..... 181/264
959,400 A * 5/1910 Stinson ..... 181/223
1,006,595 A * 10/1911 Red ..... 181/281
1,017,003 A * 2/1912 Kenney ..... 181/223
1,747,876 A * 2/1930 Metzgar ..... 181/264
1,874,326 A * 8/1932 Mason ..... 181/255
2,780,962 A * 2/1957 Murray et al. ..... 89/14.2
4,291,610 A * 9/1981 Waiser ..... 89/14.4
4,576,083 A * 3/1986 Seberger, Jr. ..... 89/14.4
4,584,924 A * 4/1986 Taguchi ..... 89/14.4
4,907,488 A * 3/1990 Seberger ..... 89/14.4
5,679,916 A * 10/1997 Weichert ..... 89/14.4
6,575,074 B1 * 6/2003 Gaddini ..... 89/14.4
7,237,467 B1 * 7/2007 Melton ..... 89/14.4
7,325,474 B2 * 2/2008 Yoshimura et al. ..... 89/14.4
7,587,969 B2 * 9/2009 Silvers ..... 89/14.4
7,905,319 B2 * 3/2011 Sullivan ..... 181/250

(Continued)

FOREIGN PATENT DOCUMENTS

WO WO 9407103 A1 * 3/1994 ..... F41A 21/30

*Primary Examiner* — Edgardo San Martin
(74) *Attorney, Agent, or Firm* — Ballard Spahr LLP

(57) ABSTRACT

A sound suppressor for a firearm, such as a shotgun, may include a rear end cap, a plurality of baffle units and a front end cap that are configured to be assembled in an end-to-end arrangement. These elements may be secured to one another with one or more elongated coupling elements that extend through the end-to-end arrangement, along with one or more complementary securing elements. Such a sound suppressor may lack an outer housing. A plurality of guide rods may extend through an interior of such a sound suppressor in a manner that provides the framework for a passage for a projectile as it moves through the sound suppressor. A barrel coupling element that may be used with a sound suppressor is also disclosed, as are methods for tailoring the length of a sound suppressor and for customizing the types and arrangement of baffles used in the sound suppressor.

23 Claims, 14 Drawing Sheets

(56) References Cited

U.S. PATENT DOCUMENTS

| | | | | |
|---|---|---|---|---|
| 8,322,266 | B2 * | 12/2012 | Presz et al. | 89/14.4 |
| 8,453,789 | B1 * | 6/2013 | Honigmann et al. | 181/223 |
| 8,516,941 | B1 * | 8/2013 | Oliver | 89/14.4 |
| 8,528,691 | B1 * | 9/2013 | Carmichael et al. | 181/223 |
| 8,857,306 | B1 * | 10/2014 | Edsall | 89/14.05 |
| 2005/0126382 | A1 * | 6/2005 | Yoshimura et al. | 89/14.4 |
| 2011/0297477 | A1 * | 12/2011 | Koumbis | 181/223 |
| 2012/0180624 | A1 * | 7/2012 | Troy et al. | 89/14.4 |
| 2014/0020977 | A1 * | 1/2014 | Shults | 181/223 |

* cited by examiner

SOUND SUPPRESSOR FOR A FIREARM

CROSS-REFERENCE TO RELATED APPLICATION

A claim for the benefit of priority under 35 U.S.C. §119(e) is hereby made to U.S. Provisional Patent Application No. 62/026,646, filed on Jul. 20, 2014, and titled SOUND SUPPRESSOR FOR A FIREARM ("the '646 Provisional application"). This application is also a continuation-in-part of U.S. Design patent application Ser. No. 29/497,008, filed on Jul. 20, 2014, and titled BAFFLE UNIT FOR A SHOTGUN SOUND SUPPRESSOR ("the '008 Design application"), U.S. Design patent application Ser. No. 29/497,009, titled BAFFLE UNIT FOR A SHOTGUN SOUND SUPPRESSOR ("the '009 Design application"), and U.S. Design patent application Ser. No. 29/497,010, titled SOUND SUPPRESSOR FOR A SHOTGUN ("the '010 Design application"), all of which were filed on Jul. 20, 2014. The entire disclosures of each of the '646 Provisional application, the '008 Design application, the '009 Design application and the '010 Design application are hereby incorporated herein.

TECHNICAL FIELD

This disclosure relates generally to sound suppressors for firearms. More specifically, this disclosure relates to sound suppressors for shotguns. This disclosure also relates to sound suppressors that lack outer housings for their baffles. In addition, various features of sound suppressors for shotguns are disclosed, including baffle units for sound suppressors for shotguns and chokes that are configured to secure a sound suppressor to the end of a barrel, or muzzle, of a shotgun. Firearms that include any of these features are also disclosed, as are methods associated with each of the above-identified features.

RELATED ART

Sound suppressors, or silencers, have long been used with a variety of different types of firearms to reduce the volume of the muzzle blast (and, to some degree, the sonic boom) that occurs as a firearm is fired, and one or more projectiles are discharged from the muzzle thereof. Conventional sound suppressors are configured for use with firearms that discharge, or fire, bullets, such as handguns (e.g., pistols, some revolvers, etc.), rifles and/or submachine guns. State-of-the-art sound suppressors are generally very effective at reducing the volume of the sound that accompanies the discharge of a bullet from the firearm, with some sound suppressors decreasing the volume that accompanies the discharge by about 20 dB to about 30 dB or more (e.g., from about 140 dB to about 160 dB down to about 110 dB to about 140 dB, etc.).

A number of efforts have been made to develop sound suppressors for shotguns. The primary challenge with silencing the muzzle blast of a shotgun involves containment of the wad and shot following their discharge from the muzzle of the shotgun and as they pass through the holes in the baffles that define chambers that are configured to decelerate and cool the rapidly expanding gases that are emitted as the wad and shot are discharged. U.S. Pat. No. 6,374,718 of Rescigno, et al., discloses one attempt at addressing this challenge, in which each baffle of a series of baffles supports a circular (or cylindrical) bushing, and the bushings are spaced apart from one another by a distance that is less the length of the wad, or cup, from a shotgun shell, or shotgun cartridge. Because the leading edge of the wad tends to expand as it is being discharged from the barrel of the shotgun and through the sound suppressor, the bushings and baffles are likely to be subjected to undesirably high incidences of so-called "baffle strike," in which the wad and the shot that it holds contact the bushings and baffles. Baffle strike may contaminate and damage the bushings and add to the sound that is generated as shot is discharged.

Another approach that has been taken to suppress the sound generated by firing a shotgun has been to form small ports in the shotgun barrel or in the barrel of a sound suppressor that may be secured to the muzzle of the shotgun barrel. The ports allow gases to escape the barrel. The gases that escape through the ports are received by, decelerated by and cooled within one or more chambers defined by a can that surrounds the port-bearing portion of the barrel. Since the sizes and locations of the ports are limited, however, they limit the volume of expanding gases that will be received by, decelerated by and cooled within the chamber(s) of the sound suppressor. Thus, the extent to which the volume of a muzzle blast from a shotgun is decreased by such a sound suppressor may be undesirably limited.

SUMMARY

In one aspect, sound suppressors, which are also referred to as "suppressors" and as "silencers," for shotguns and other firearms are disclosed. A sound suppressor according to this disclosure includes a plurality of baffle units that are configured to be arranged and secured to one another in series, as well as a plurality of guide rods positioned along a length of an interior of the sound suppressor.

As used herein, the term "rear" refers to an element or a portion or end of an element that is configured to be positioned toward, or facing, the muzzle of a shotgun or another firearm as a sound suppressor of which the element is a part is assembled with the firearm. The term "front" refers to elements or the portions or ends of elements that face away from, or in the same direction as, the muzzle of a shotgun or another firearm as a sound suppressor of which the element is a part is assembled with the firearm.

Each baffle unit includes a partially closed rear end, or muzzle-facing end, as well as a spacer that extends laterally from the partially closed rear end and that defines at least a part of an open front end of the baffle unit. The partially closed rear end of the baffle unit functions as a baffle, and includes an aperture through which a wad and shot will pass. The partially closed rear end, the spacer and a surface of structure (e.g., a partially closed rear end of another baffle unit with which the baffle unit is assembled, a front end cap of the sound suppressor, etc.) define a chamber of a sound suppressor.

The apertures in the partially closed rear ends of a plurality of the baffle units are circular, each having a diameter that is the same or slightly larger than the inner diameter of the barrel of the shotgun or other firearm with which the sound suppressor is configured to be used, and each being positioned to align with the barrel of the shotgun or other firearm. A baffle unit having this type of configuration is referred to herein as a "confined baffle unit." In addition, guide rod receptacles may be positioned at spaced part locations around the circumference of each circular aperture. Each guide rod receptacle may be configured to receive a guide rod.

The apertures through the partially open rear ends of one or more other baffle units of a sound suppressor are much larger. In some embodiments, an entire upper portion or substantially the entire upper portion (i.e., with the exception of a periphery of the upper portion) of the rear end of an open baffle unit may be open. Accordingly, such a baffle unit is also referred to herein as an "open baffle unit." The aperture through the partially open rear end of each open baffle unit may accommodate guide rods that are arranged along the length of the interior of the sound suppressor.

A sound suppressor according to this disclosure includes at least two confined baffle units. In some embodiments, at least one open baffle unit may be positioned between two confined baffle units. In a more specific embodiment, confined baffle units and open baffle units may be arranged in alternating sequence. In other embodiments, two or more confined baffle units may be positioned adjacent to one another. Even more specifically, all of the baffle units of a sound suppressor may comprise confined baffle units.

The guide rods that extend through the interior of the sound suppressor may be arranged in such a way that their innermost surfaces align with the circumferences of the circular apertures and/or with the inner surface of the barrel of a shotgun or other firearm with which the sound suppressor is configured to be assembled. As indicated previously herein, the guide rods may be positioned and held in place within guide rod receptacles arranged around the circumferences of the circular apertures of the confined baffle units. In some embodiments, the guide rods may extend through the entire length of the interior of the sound suppressor. In such embodiments, each end of each guide rod may be engaged by a corresponding feature or otherwise secured to a rear end cap and/or a front end cap of the sound suppressor.

The baffle units and the rear end cap and front end cap of a sound suppressor according to this disclosure may be configured to be assembled in a manner that negates the need for a tube or other housing around the outer surfaces of the sound suppressor. In some embodiments, the rear end cap, the baffle units and the front end cap may be configured to snap together, providing an interference fit that may enable disassembly of these pieces from one another. The rear end cap, the baffle units and the front end cap may seal against one another in a manner that reinforces and seals the joint between each of these elements and prevents gases from escaping through each joint as a shotgun or other firearm with which the sound suppressor is used is fired (e.g., by way of tongue-and-groove type connections, etc.). Optionally, one or more elongated coupling elements may be configured to secure the rear end cap, the baffle units and the front end cap in an assembled relationship, and may compress these elements together in a manner that further reinforces the joints between them.

The configurations of the rear end cap, the baffle units and the front end cap may enable tailoring of the length of the sound suppressor. In embodiments where the sound suppressor includes guide rods or elongated coupling elements that extend along the entire length of the sound suppressor, guide rods and/or elongated coupling elements of different lengths may be provided to enable tailoring of the length of the sound suppressor. The configurations of the rear end cap, the baffle units and the front end cap may also enable customization of the manner in which baffles of one or more types are arranged along the length of the sound suppressor.

The rear end cap of a sound suppressor, which is configured to be positioned adjacent to the muzzle of a shotgun or another firearm, may include or carry a barrel coupling element that is configured to secure the sound suppressor in place at the end of the muzzle. The barrel coupling element may be configured for insertion into the barrel through the muzzle, and to engage threads within the barrel near its muzzle end. A passage through the barrel coupling element may have the same inner diameter as the barrel. In some embodiments, the barrel coupling element may comprise a choke that is configured to be coupled to the barrel of a shotgun or another firearm, a receiving element secured to the rear end cap of the sound suppressor and configured to be assembled with the choke (e.g., to receive a front end of the choke, etc.) and a connector for securing the choke and the receiving element to one another. The connector may be configured to remain on the choke even when the choke and the receiving element are disassembled and, therefore, the sound suppressor is not coupled to the barrel of the shotgun or other firearm. In some embodiments, the choke and/or the connector may be configured to secure the connector in a stationary position on the choke (e.g., with complementary threads, complementary locking features, magnetically, etc.).

Another aspect of this disclosure relates to methods for tailoring the organization and/or length of a sound suppressor. Such a method may include selecting baffle units having one or more desired orientations, organizing the baffle units in series, with the baffle unit at each location in the series having a desired configuration (e.g., an open configuration, a constricted configuration, etc.). A rear end cap, along with inner and outer receiving elements of a barrel coupling element that have been assembled with the rear end cap, and a front end cap may then be placed at appropriate locations relative to the series of baffle units. In some embodiments, assembly of these elements may include placement of guide rods through the interior of the assembly. The rear end cap, the baffle units, the front end cap and any guide rods that were assembled with these elements may be secured together with elongate coupling elements and complementary securing elements. The elongate coupling elements and any guide rods that are included in the assembly may have lengths that will impart the overall assembly, and the sound suppressor, with a desired length.

In yet another aspect, this disclosure relates to methods for securing a sound suppressor to a firearm. Such a method may include securing a choke of a barrel coupling element to a barrel of a shotgun or another firearm. A connector, which may have an annular configuration, may be placed on or assembled with a rear portion of the choke before the choke is assembled with the barrel of the shotgun or other firearm. The choke may be secured to the barrel by inserting a rear portion of the choke into the muzzle of the barrel and causing threads on the rear portion of the choke to engage complementary threads within the barrel (e.g., by rotating the choke in a clockwise direction relative to the muzzle of the barrel, etc.).

The choke may be assembled with an outer receiving element of the barrel coupling element, which may protrude from the rear side, or muzzle-facing side, of the sound suppressor (e.g., from a rear end cap thereof, etc.). The connector may be used to secure the choke and the outer receiving element of the barrel coupling element to one another. In some embodiments, the connector may include features that force the choke further toward the outer receiving element as engagement features of the connector engage complementary engagement features of the outer receiving element. Before the connector fully engages the outer receiving element, the sound suppressor may be rotated to a desired orientation relative to the shotgun or other firearm. With the sound suppressor in a desired orientation, the connector may fully engage the outer receiving element, holding the sound suppressor in place, and in a desired orientation, relative to the shotgun or other firearm.

Other aspects, as well as features and advantages of various aspects, of the disclosed subject matter will become apparent to those of ordinary skill in the art through consideration of the ensuing description, the accompanying drawings and the appended claims.

BRIEF DESCRIPTION OF THE DRAWINGS

In the drawings:

FIG. 2B providing a rear isometric view; FIG. 2C providing a front plan view; FIG. 2D providing a rear plan view; FIG. 2E providing a left side view; FIG. 2F providing a right side view; FIG. 2G providing a top view and FIG. 2H providing a bottom view;

FIG. 3B providing a rear isometric view; FIG. 3C providing a front view; FIG. 3D providing a rear view; FIG. 3E providing a left side view; FIG. 3F providing a right side view; FIG. 3G providing a top view and FIG. 3H providing a bottom view;

FIG. 4B providing a rear isometric view; FIG. 4C providing a front view; FIG. 4D providing a rear view; FIG. 4E providing a left side view; FIG. 4F providing a right side view; FIG. 4G providing a top view and FIG. 4H providing a bottom view;

FIG. 5B providing a rear isometric view; FIG. 5C providing a front plan view; FIG. 5D providing a rear plan view; FIG. 5E providing a left side view; FIG. 5F providing a right side view; FIG. 5G providing a top view and FIG. 5H providing a bottom view;

FIG. 6B providing a rear isometric view; FIG. 6C providing a front plan view; FIG. 6D providing a rear plan view; FIG. 6E providing a left side view; FIG. 6F providing a right side view; FIG. 6G providing a top view and FIG. 6H providing a bottom view;

FIG. 11B providing a rear isometric view; FIG. 11C providing a front plan view; FIG. 11D providing a rear plan view; FIG. 11E providing a left side view; FIG. 11F providing a right side view; FIG. 11G providing a top view and FIG. 11H providing a bottom view;

FIG. 12B providing a rear isometric view; FIG. 12C providing a front plan view; FIG. 12D providing a rear plan view; FIG. 12E providing a left side view; FIG. 12F providing a right side view; FIG. 12G providing a top view and FIG. 12H providing a bottom view;

FIG. 13B providing a rear isometric view; FIG. 13C providing a front plan view; FIG. 13D providing a rear plan view; FIG. 13E providing a left side view; FIG. 13F providing a right side view; FIG. 13G providing a top view and FIG. 13H providing a bottom view.

DETAILED DESCRIPTION

Figure 1:
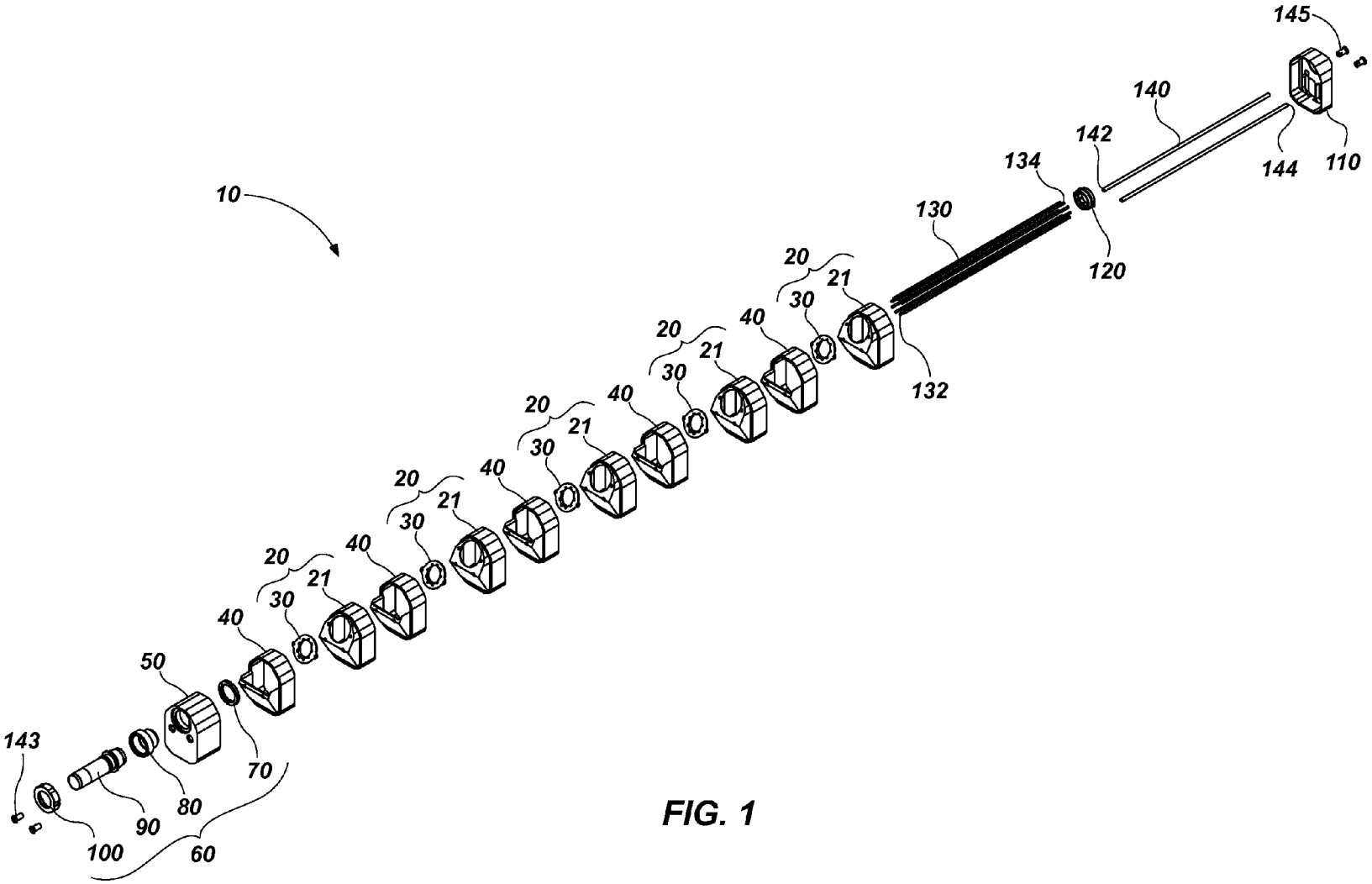
FIG. 1 is an exploded assembly view of an embodiment of a sound suppressor according to this disclosure.
Figure 2A:
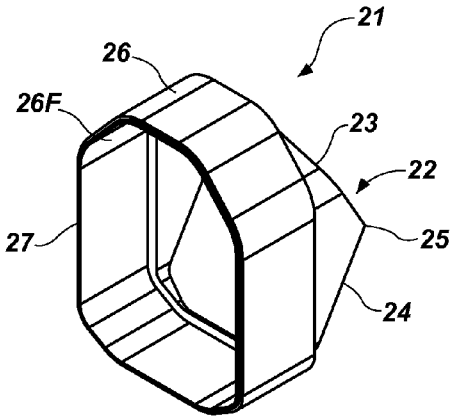
FIGS. 2A through 2H illustrate an embodiment of a confined baffle unit of the embodiment of sound suppressor illustrated by FIG. 1, with FIG. 2A providing a front isometric view.
Figure 2B:
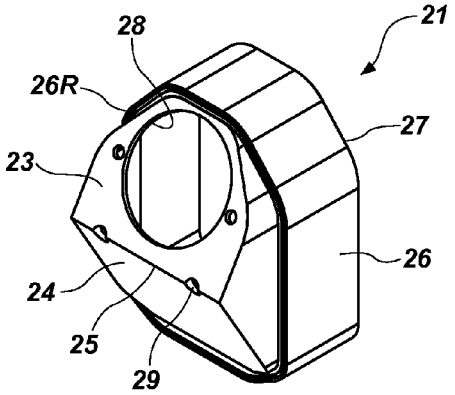
Figure 2C:
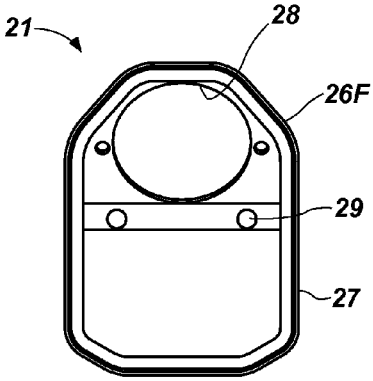
Figure 2D:
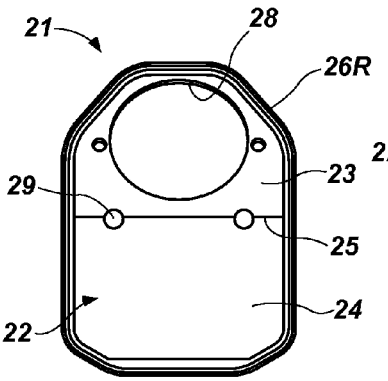
Figure 2E:
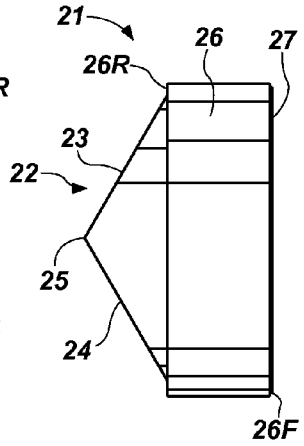
Figure 2F:
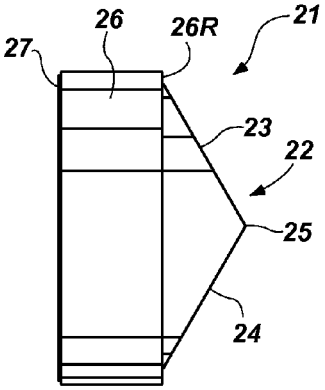
Figure 2G:
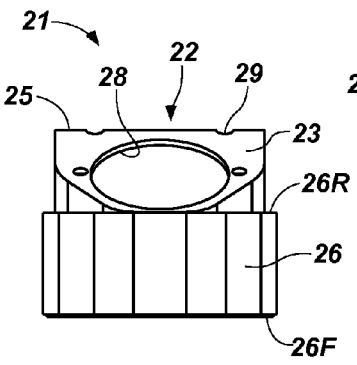
Figure 2H:
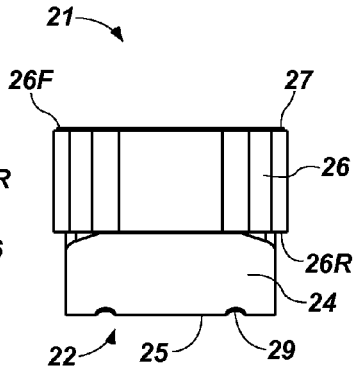
Figure 3A:
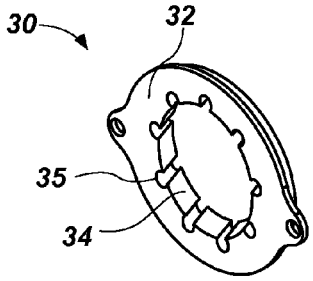
FIGS. 3A through 3H illustrate an embodiment of an insert that may be used with or comprise part of a confined baffle unit, such as that depicted by FIGS. 2A through 2H, with FIG. 3A providing a front isometric view.
Figure 3B:
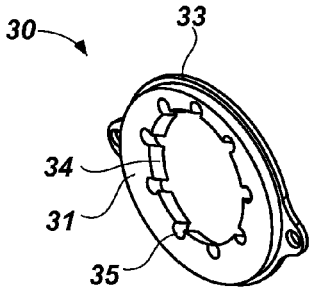
Figure 3C:
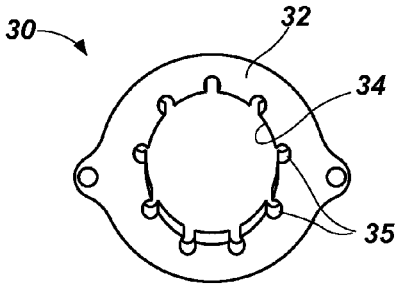
Figure 3D:
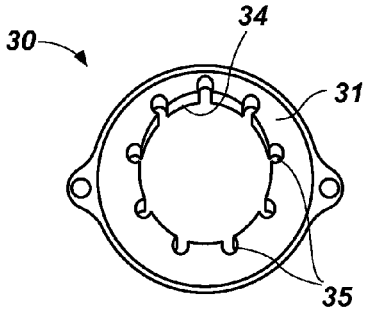
Figure 3E:
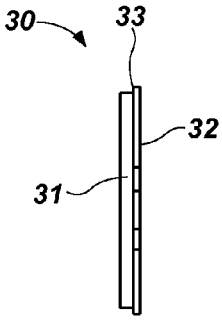
Figure 3F:
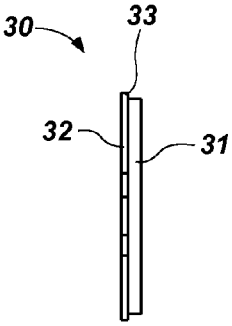
Figure 3G:
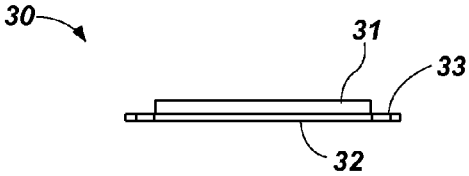
Figure 3H:
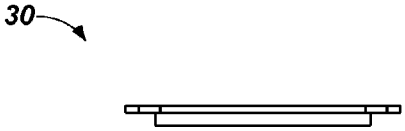
Figure 4A:
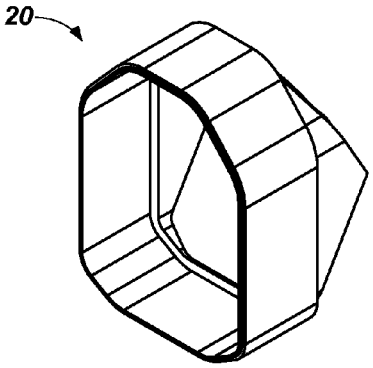
FIGS. 4A through 4H illustrate an embodiment of confined baffle unit assembly including the baffle unit of FIGS. 2A through 2H and the insert of FIGS. 3A through 3H, with FIG. 4A providing a front isometric view.
Figure 4B:
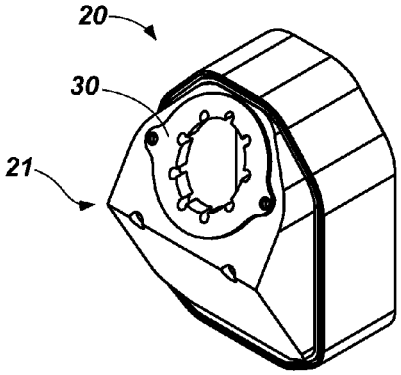
Figure 4C:
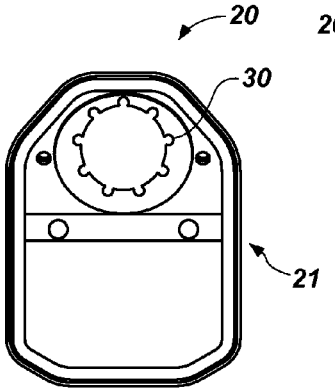
Figure 4D:
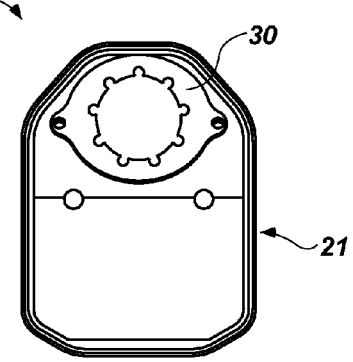
Figure 4E:
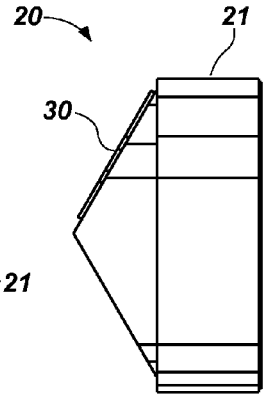
Figure 4F:
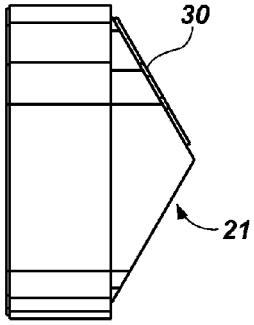
Figure 4G:
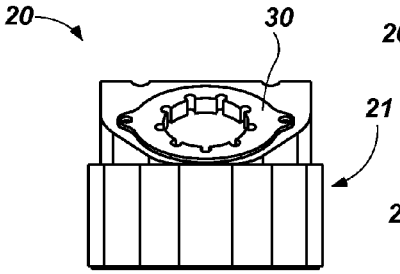
Figure 4H:
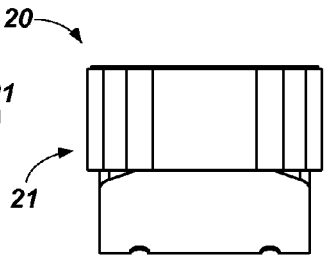

An embodiment of a sound suppressor 10 for a shotgun or another firearm is shown in FIG. 1. The sound suppressor 10 includes a plurality of baffle units 20 and 40 that are arranged and assembled in series between a rear end cap 50, which is configured to be positioned adjacent to a muzzle end of the barrel of a shotgun or another firearm, and a front end cap 110, through which shot or another projectile is to be discharged. A plurality of guide rods 130 are configured to extend through the baffle units 20 and 40, and are arranged in a manner that will guide a wad, or shot cup, and the shot contained thereby as it exits the muzzle of a firearm and travels through the interior of the sound suppressor 10.

In the embodiment shown in FIG. 1, the guide rods 130 may be arranged in a manner that forms the framework of a passage that extends through the assembled baffle units 20 and 40, but that provides sufficient open space to enable gases to flow from the passage into chambers defined by the baffle units 20 and 40. More specifically, the guide rods 130 may be arranged to form the framework of a cylinder. Features of at least some of the baffle units 20 and 40 may support the guide rods 130, and the rear end 132 of each guide rod 130 may be held in place by a corresponding feature of the rear end cap 50, while the front end 134 of each guide rod 130 may be held in place by a corresponding feature of the front end cap 110, as disclosed in further detail hereinafter.

The sound suppressor 10 may also include a barrel coupling element 60, which is configured to secure the sound suppressor 10 in place relative to the muzzle of a shotgun or another firearm. In the embodiment depicted by FIG. 1, the barrel coupling element 60 includes an inner receiving element 70, an outer receiving element 80, a choke 90 and a connector 100. The outer receiving element 80 is configured to be introduced into an aperture in a rear surface of the rear end cap 50. Configurations of the outer receiving element 80 and the rear surface of the rear end cap 50 may prevent excessive forward movement of the outer receiving element 80 when it is assembled with the rear end cap 50, while the inner receiving element 70 may be secured at a front of the outer receiving element 80 that resides within an interior of the rear end cap 50 to secure the outer receiving element 80 to the rear end cap 50. The choke 90 may be configured to engage the barrel of a shotgun or another firearm, and to be assembled with the outer receiving element 80 when assembly of the sound suppressor 10 with the barrel of a shotgun or another firearm is desired. The connector 100 may be configured to secure the outer receiving element 80 to the choke 90, for example, when assembly of the sound suppressor 10 with the barrel of a shotgun or another firearm is desired.

Figure 13A:
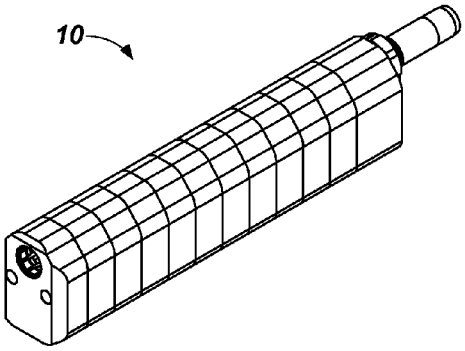
FIGS. 13A through 13H depict an embodiment of sound suppressor including the elements shown in FIGS. 2A through 12H, with FIG. 13A providing a front isometric view.
Figure 13B:
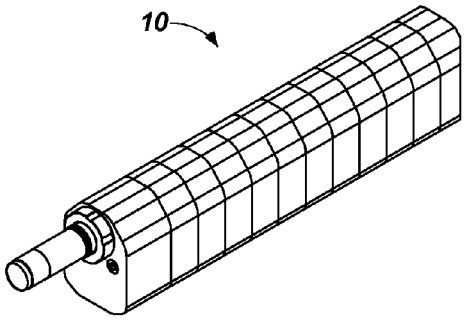
Figure 13C:
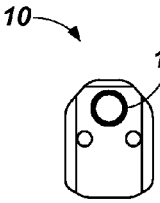
Figure 13D:
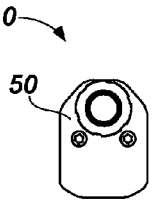
Figure 13E:
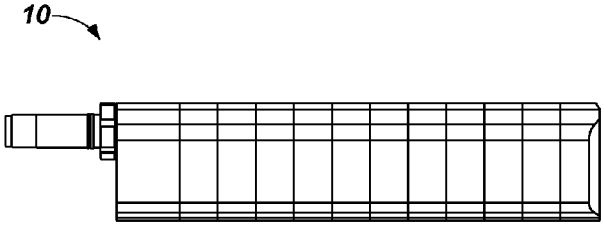
Figure 13F:
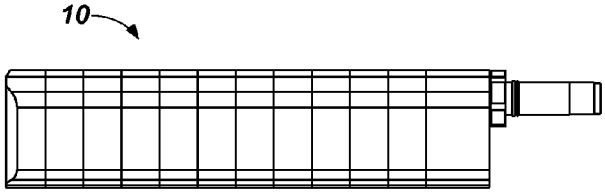
Figure 13G:
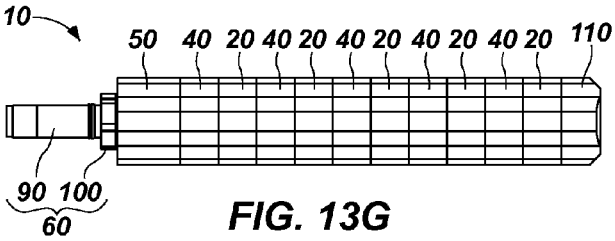
Figure 13H:
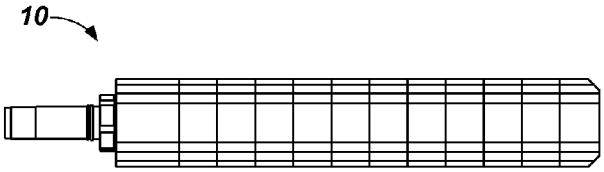
Figure 14:
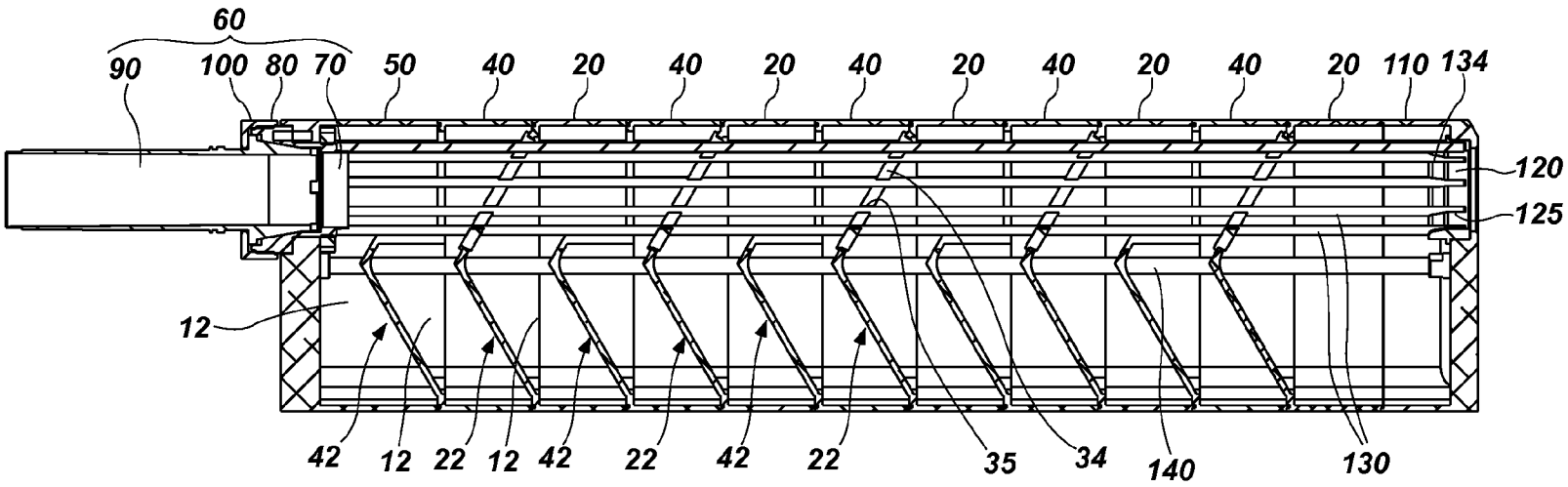
FIG. 14 is a cross-sectional representation of the embodiment of sound suppressor illustrated by FIGS. 13A through 13H.

The baffle units 20 and 40, the rear end cap 50, the front end cap 110 and the guide rods 130 may be held in an assembled relationship, such as that depicted by FIGS. 13A through 14, by interlocking features that mutually engage one another as the baffle units 20 and 40, the rear end cap 50 and the front end cap 110 are assembled with one another.

In addition, one or more elongated coupling elements 140 may extend through the length of the assembled rear end cap 50, baffle units 20 and 40 and front end cap 110 and be assembled with these elements in a manner that holds the assembly together. Without limitation, as shown in FIG. 1, each elongated coupling element 140 may include a rear end 142 that is threaded in a manner that enables it to engage a securing element 143 (e.g., the rear end 142 may be configured to receive a securing element 143 that comprises a bolt, the rear end 142 may be configured to be received by a securing element 143 that comprises a nut, etc.). More specifically, the securing element 143 may be configured to engage the rear end 142 of the elongated coupling element 140 at a location adjacent to a rear surface of the rear end cap 50. When the securing element 143 engages the rear end 142 of the elongated coupling element 140 at such a location, the securing element 143 may be configured to prevent forward movement of the elongated coupling element 140 relative to the rear end cap 50. Likewise, the front end 144 of each elongated coupling element 140 may be configured to be engaged by a securing element 145 at a front end 117 of the front end cap 110 of the sound suppressor 10. The configuration of the securing element 145 may prevent rearward movement of the elongated coupling element 140 when its front end 144 is secured in place by the securing element 145 relative to the front surface of the front end cap 110.

Various elements of the embodiment of sound suppressor 10 shown in FIG. 1 will now be described in further detail in reference to FIGS. 2A through 12H.

In FIGS. 2A through 2H, an embodiment of the body 21 of a baffle unit 20 (FIG. 1; FIGS. 4A through 4H) is depicted. The baffle unit 20 comprises a constricted baffle unit, and includes an opening that may be only slightly larger than the projectile (e.g., shot and an accompanying wad, etc.) discharged by a shotgun or another firearm with which the sound suppressor 10 is configured to be used. The body 21 includes a rear end 22, a spacer 26 and a front end 27. The body 21 may be made from any suitable material. In a specific embodiment, aluminum may be used due to its structural integrity, its suitability for use in high-throughput manufacturing processes (e.g., mass production, etc.) and its light weight and low cost relative to other materials having these properties.

The spacer 26 defines an outer periphery of the body 21, as well as the distance that the rear end 22 will be positioned from a corresponding surface of an adjacent element of the sound suppressor 10 (FIG. 1) of which the baffle unit 20 (FIG. 1; FIGS. 4A through 4H) is a part.

The rear end 22 of the body 21 of the baffle unit 20 (FIG. 1; FIGS. 4A through 4H) may function as a baffle within an assembled sound suppressor 10 (FIG. 1). The rear end 22 is configured to be oriented toward the muzzle of a shotgun or another firearm when a sound suppressor 10 of which the baffle unit 20 is a part is assembled with the firearm. In the embodiment illustrated by FIGS. 2A through 2H, the rear end 22 includes an upper element 23 and a lower element 24 that extend rearward from the spacer 26 at convergent angles, and meet at a ridge 25, which extends laterally and may be located about midway along a height of the body 21.

In embodiments such as that depicted by FIGS. 2A through 2H, the rear end 22 of the body 21 of the baffle unit 20 (FIG. 1; FIGS. 4A through 4H) may be configured to be received within an opening at the front end 27, 47 (FIGS. 5A through 5H) of an adjacent baffle unit 20, 40 (FIG. 1; FIGS. 5A through 5H) or the front end 57 (FIGS. 6A through 6H) of the rear end cap 50 (FIG. 1; FIGS. 6A through 6H) when the adjacent baffle unit 20, 40 or rear end cap 50 is assembled with the rear end 22 of the baffle unit 20. In addition, the spacer 26 (e.g., a rear edge 26R (FIGS. 2A through 2H) of the spacer 26, etc.) and/or the rear end 22 of the body 21 of the baffle unit 20 may be configured to mutually engage corresponding features at a front end 27, 47 of another baffle unit 20, 40 or at a front end 57 (FIGS. 6A through 6C and 6E through 6H) of a rear end cap 50 when that baffle unit 20, 40 or rear end cap 50 is assembled at the rear of the baffle unit 20. In more specific embodiments, mating features of the adjacent baffle units 20, 40 may comprise a recessed edge and a corresponding receptacle, a tongue-and-groove type arrangement or any other suitable arrangement.

An opening 28 is defined through the upper element 23 of the rear end 22 of the body, and is configured to accommodate a projectile as it passes through the body 21 of the baffle unit 20. In the illustrated embodiment, the opening 28 is further configured to receive an insert 30 (FIG. 1; FIGS. 3A through 3H) that may be secured to the body 21 of the baffle unit 20.

One or more coupling apertures 29 may also be defined through the rear end 22 of the body 21. Each coupling aperture 29 may be configured to receive an elongated coupling element 140 that holds the baffle unit 20 (FIG. 1; FIGS. 4A through 4H) and the elements with which it is assembled in the assembled relationship that defines the sound suppressor 10 (FIG. 1).

As indicated previously herein, an opening 28 may be defined through the front end 27 of the body 21 of the baffle unit 20 (FIG. 1; FIGS. 4A through 4H). In some embodiments, such as that depicted by FIGS. 2A and 2C, the front end 27 may be configured to receive the rear end 22, 42 (FIGS. 5A through 5H) of another baffle unit 20, 40 (FIGS. 5A through 5H) or the rear end 112 (FIGS. 11B and 11D through 11H) of a front end cap 110 (FIGS. 11A through 11H) positioned in front of the front end 27 of the baffle unit 20. The front end 27 of the body 21, which may be defined by a front edge 26F of the spacer 26 of the body 21, may be configured to engage or to be engaged by a corresponding feature (e.g., tongue-and-groove, recessed edge and corresponding receptacle, etc.) at or adjacent to the rear edge 26R, 46R (FIGS. 5A through 5H) of the spacer 26, 46 (FIGS. 5A through 5H) of another baffle unit 20, 40 or the rear edge 116R (FIGS. 11A, 11B and 11D through 11H) of a front end cap 110 (FIGS. 11A through 11H) that has been positioned in front of and assembled with the baffle unit 20.

An embodiment of an insert 30 that is configured for use with the embodiment of body 21 shown in FIGS. 2A through 2H is illustrated by FIGS. 3A through 3H. The insert 30 may comprise a material that will withstand repeated use, as well as occasional impacts by projectiles, such as shot, or BB's, discharged from a shotgun. In a specific embodiment, the insert 30 may comprise steel, which is more durable than the aluminum that may be used to define a specific embodiment of the body 21.

In the illustrated embodiment, the insert 30 includes a rear end 31 that is configured to be received by the opening 28 (FIGS. 2B through 2D and 2G) in the rear end 22 (FIGS. 2A through 2H) of the body 21 (FIGS. 2A through 2H). A front end 32 of the insert 30 includes at least one lateral dimension (e.g., a diameter, etc.) that is larger than a corresponding lateral dimension of the rear end 31, providing a ledge 33 that extends laterally beyond an outer peripheral extent of the rear end 31. The ledge 33 may prevent over-insertion of the insert 30 into or through the opening 28, and may enable coupling of the insert 30 to the body 21.

A primary aperture 34 extends through the width of the insert 30. The primary aperture 34 has a diameter that is the same or larger than the inner diameter of a barrel of a shotgun or other firearm with which a sound suppressor 10 (FIG. 1) of which the insert 30 is a part is configured to be used. Thus, the primary aperture 34 may accommodate a projectile (e.g., shot and a wad, etc.) that has been discharged from the firearm.

In some embodiments, a plurality of guide rod receptacles 35 may be positioned at spaced apart locations around a circumference of the primary aperture 34. The guide rod receptacles 35 may be recessed relative to the circumference of the primary aperture 34. Each guide rod receptacle 35 is configured to receive and at least partially retain a portion of a guide rod 130 (FIG. 1). Taken together, the guide rod receptacles 35 of an insert 30 may at least partially hold the guide rods 130 in an arrangement that guides a projectile as it moves through the sound suppressor 10, while minimizing damage that might otherwise occur within the sound suppressor 10 and enabling gases to efficiently exit the projectile's path and enter into the chambers defined within the sound suppressor 10.

An embodiment of a baffle unit 20 that includes the embodiment of insert 30 illustrated by FIGS. 3A through 3H assembled with the embodiment of body 21 illustrated by FIGS. 2A through 2H is shown in FIGS. 4A through 4H.

Turning now to FIGS. 5A through 5H, an embodiment of a baffle unit 40 that comprises an open baffle unit is depicted. The baffle unit 40 includes a body 41 with a rear end 42, a spacer 46 and a front end 47. The body 41 may be made from any suitable material. In a specific embodiment, aluminum may be used due to its structural integrity, its suitability for use in high-throughput manufacturing processes (e.g., mass production, etc.) and its light weight.

The spacer 46 of the body 41 of the baffle unit 40 defines an outer periphery of the body 41, as well as the distance that the rear end 42 will be positioned from a corresponding surface of an adjacent element of the sound suppressor 10 (FIG. 1) of which the baffle unit 40 (FIG. 1; FIGS. 4A through 4H) is a part.

The rear end 42 of the body 41 of the baffle unit 40 may function as a baffle within an assembled sound suppressor 10 (FIG. 1). The rear end 42 is configured to be oriented toward the muzzle of a shotgun or another firearm when a sound suppressor 10 of which the baffle unit 40 is a part is assembled with the firearm. In the embodiment illustrated by FIGS. 5A through 5H, the rear end 42 includes an upper element 43 and a lower element 44 that are joined at a ridge 45, which may be located about midway along a height of the body 41, and extend away from the ridge 45 toward opposite sides of the spacer 46 (e.g., the top and bottom of the spacer 46, etc.) at divergent angles. The lower element 44 of the rear end 42 may extend completely to the spacer 46, while the upper end 43 of the rear end 42 may extend only partially toward the spacer 46, providing a relatively large opening 48 at an upper portion of the rear end 42.

The opening 48 through the rear end 42 of the body 41 of the baffle unit 40 may be configured to accommodate the guide rods 130 (FIG. 1) of the sound suppressor 10 (FIG. 1), as well as a projectile as it passes through the body 41 of the baffle unit 40.

In embodiments such as that depicted by FIGS. 5A through 5H, the rear end 42 of the body 41 of the baffle unit 40 may be configured to be received within an opening 28 at the front end 27 (FIGS. 4A through 4H), 47 of an adjacent baffle unit 20 (FIG. 1; FIGS. 4A through 4H), 40 or at the front end 57 (FIGS. 6A through 6H) of the rear end cap 50 (FIG. 1; FIGS. 6A through 6H) when the adjacent baffle unit 20, 40 or rear end cap 50 is assembled with the rear end 42 of the baffle unit 40. In addition, the spacer 46 (e.g., a rear edge 46R of the spacer 46, etc.) and/or the rear end 42 of the body 41 of the baffle unit 40 may be configured to mutually engage corresponding features at a front end 27, 47 of another baffle unit 20, 40 or at a front end 57 (FIGS. 6A through 6C and 6E through 6H) of a rear end cap 50 when that baffle unit 20, 40 or rear end cap 50 is assembled at the rear end 42 of the baffle unit 40.

One or more coupling apertures 49 may also be defined through the rear end 42 of the body 41 of the baffle unit 40. Each coupling aperture 49 may be configured to receive an elongated coupling element 140 that holds the baffle unit 40 (FIG. 1; FIGS. 5A through 5H) and the elements with which it assembled in the assembled relationship that defines the sound suppressor 10 (FIG. 1).

Figure 5A:
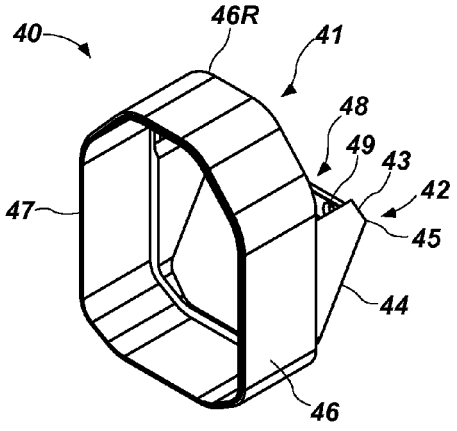
FIGS. 5A through 5H show an embodiment of an open baffle unit of the embodiment of sound suppressor illustrated by FIG. 1, with FIG. 5A providing a front isometric view.
Figure 5B:
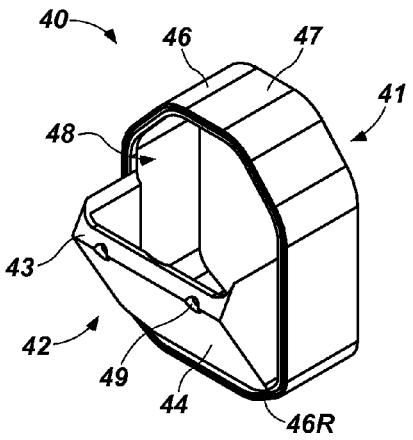
Figure 5C:
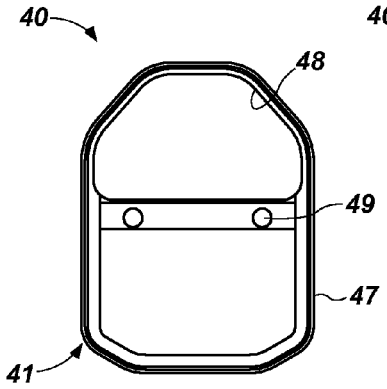
Figure 5D:
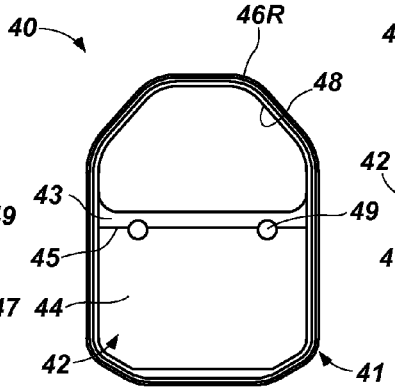
Figure 5E:
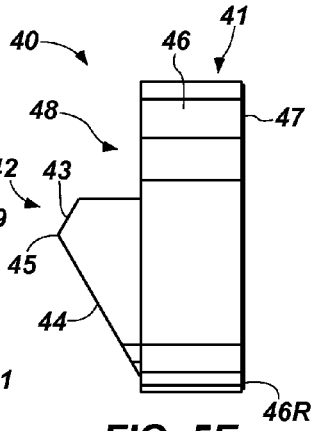
Figure 5F:
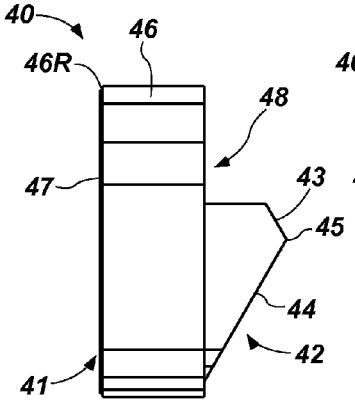
Figure 5G:
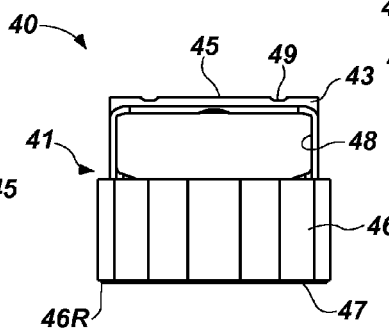
Figure 5H:
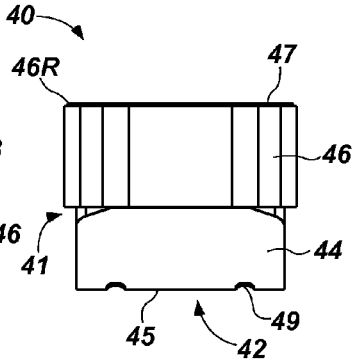

As best depicted by FIG. 5A, an opening may be defined through the front end 47 of the body 41 of the baffle unit 40. In some embodiments, the front end 47 may be configured to receive the rear end 22 (FIGS. 4A through 4H), 42 of another baffle unit 20 (FIGS. 4A through 4H), 40 or the rear end 112 (FIGS. 11B and 11D through 11H) of a front end cap 110 (FIGS. 11A through 11H) positioned in front of the front end 47 of the baffle unit 40. The front end 47 of the body 41, which may be defined by a front edge 46F of the spacer 46 of the body 41, may be configured to engage or to be engaged by a corresponding feature at or adjacent to the rear edge 26R (FIGS. 2A, 2B and 2C through 2H), 46R of the spacer 26 (FIGS. 4A through 4H), 46 of another baffle unit 20, 40 or the rear edge 116R (FIGS. 11A, 11B and 11D through 11H) of a front end cap 110 (FIGS. 11A through 11H) that has been positioned in front of and assembled with the baffle unit 40.

With reference turned to FIGS. 6A through 6H, an embodiment of a rear end cap 50 is depicted that may be included in a sound suppressor 10 (FIG. 1) according to this disclosure. The rear end cap 50 includes a rear end 52, a spacer 56 extending forward about the outer periphery of the rear end 52 and a front end 57 defined at least partially by a front edge 56F of the spacer 56.

The rear end 52 of the rear end cap 50 includes an opening 58, which is configured to receive a portion of a barrel coupling element 60 (FIG. 1) of the sound suppressor 10 (FIG. 1). The opening 58 may include an inner portion 581 and an outer portion 580 that is counterbored about a periphery of the inner portion 581, is concentric with the inner portion 581 and defines a rearward facing ledge 58L. The inner portion 581 and the outer portion 580 of the opening 58 may be configured to receive corresponding features of an outer receiving element 80 (FIG. 1; FIGS. 8A through 8E) of the barrel coupling element 60, as will be described in further detail hereinafter, in reference to FIGS. 8A through 8E.

The rear end 52 of the rear end cap 50 may also include one or more coupling apertures 59. Each coupling aperture 59 may include a counterbored outer portion and a smaller inner portion to accommodate a securing element 143 that is configured to engage the rear end 142 of an elongated coupling element 140, enabling the securing element 143 to be secured to the rear end 142 and enabling the elongated coupling element 140, the securing element 143 and another securing element 145 at a front end 144 of the elongated coupling element to collectively force the rear end cap 50 and other elements of the sound suppressor 10 (FIG. 1) toward one another.

Figure 6A:
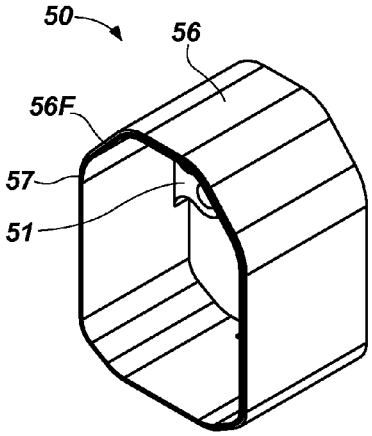
FIGS. 6A through 6H depict an embodiment of a rear end cap of the embodiment of sound suppressor illustrated by FIG. 1, with FIG. 6A providing a front isometric view.
Figure 6B:
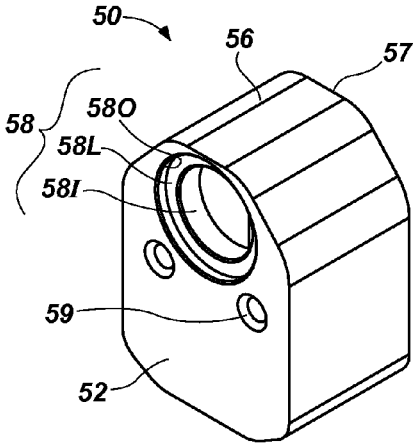
Figure 6C:
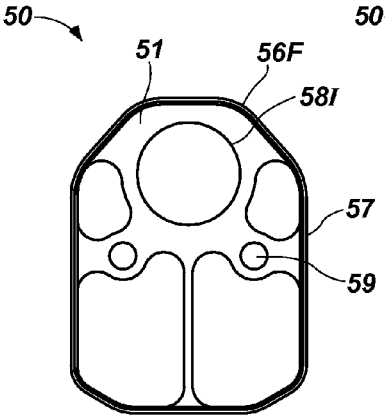
Figure 6D:
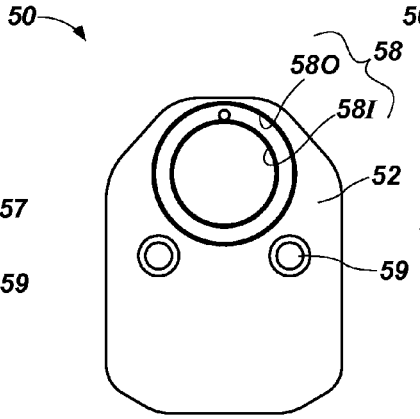
Figure 6E:
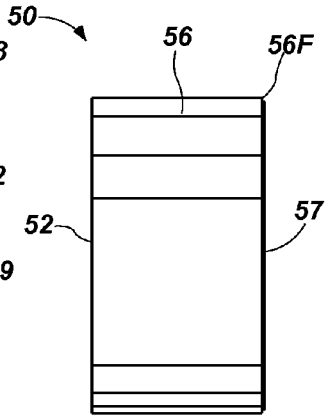
Figure 6F:
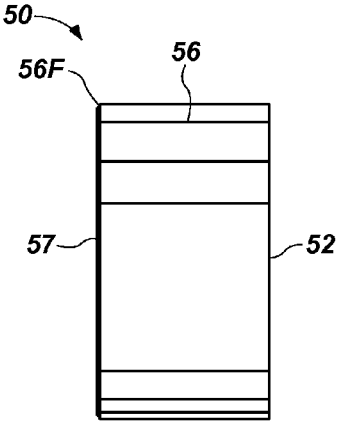
Figure 6G:
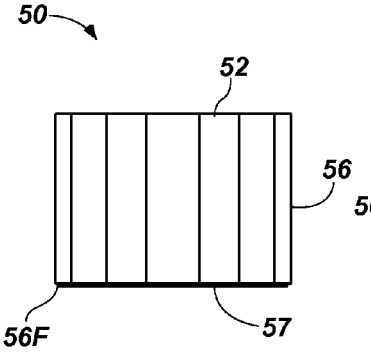
Figure 6H:
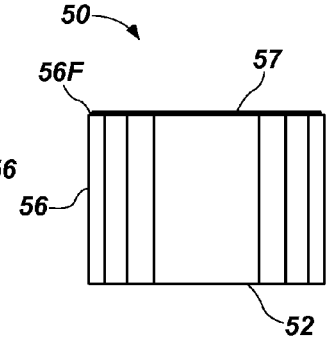
Figure 7A:
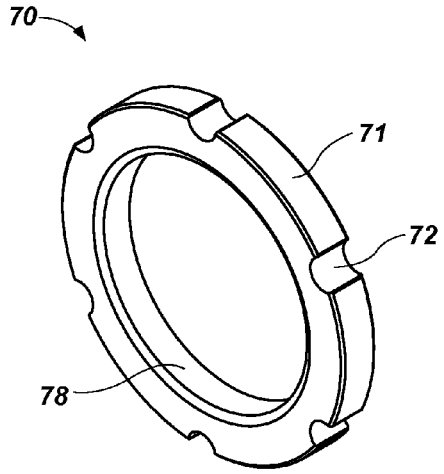
FIGS. 7A through 10E show an embodiment of barrel coupling element of or configured to be carried by the rear end cap shown in FIGS. 6A through 6H, with FIGS. 7A through 7E illustrating an embodiment of an inner member of a receiving element of the barrel coupling element, FIGS. 8A through 8E showing an embodiment of an outer member of the receiving element, FIGS. 9A through 9E depicting a choke of the barrel coupling element and FIGS. 10A through 10E showing an embodiment of a connector of the barrel coupling element.
Figure 7B:
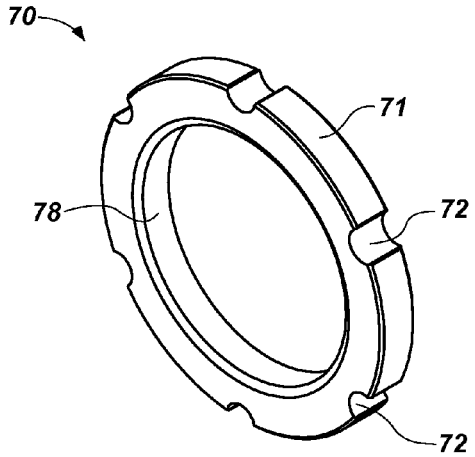
Figure 7C:
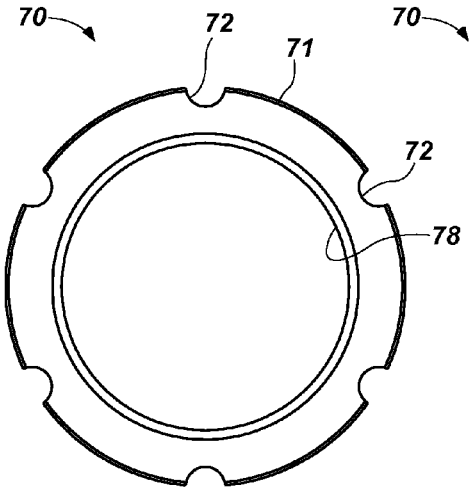
Figure 7E:
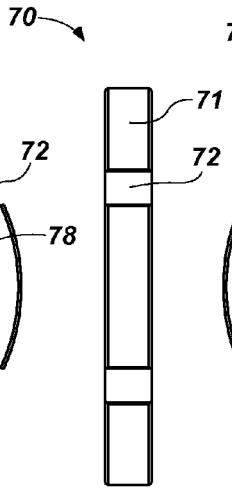
Figure 7D:
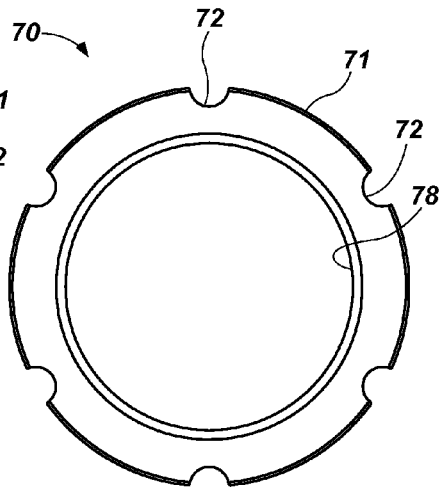
Figure 8A:
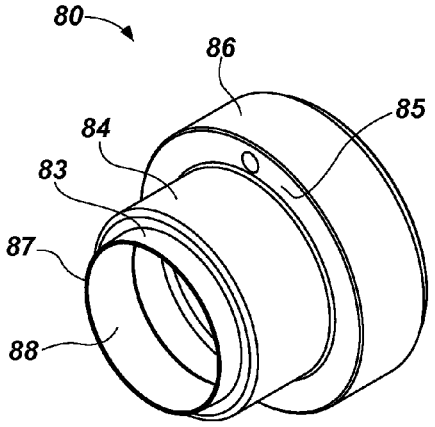
Figure 8B:
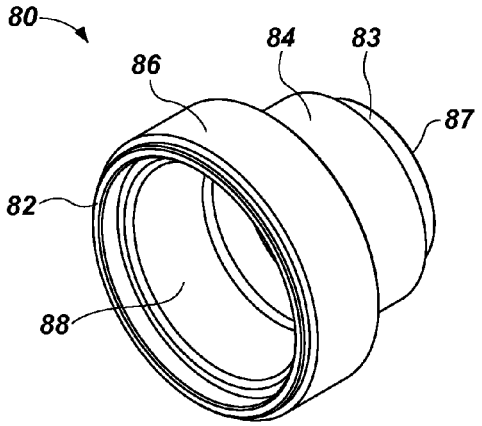
Figure 8C:
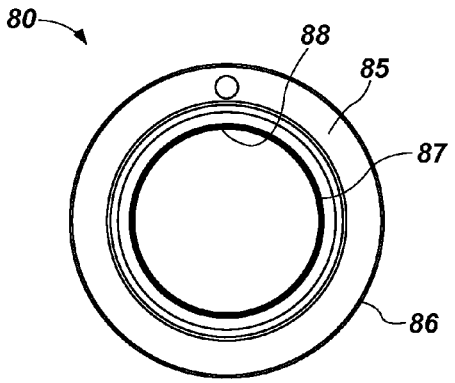
Figure 8D:
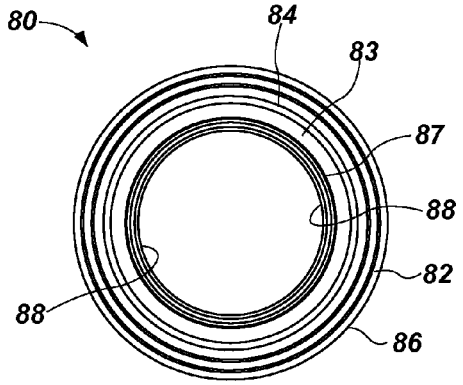
Figure 8E:
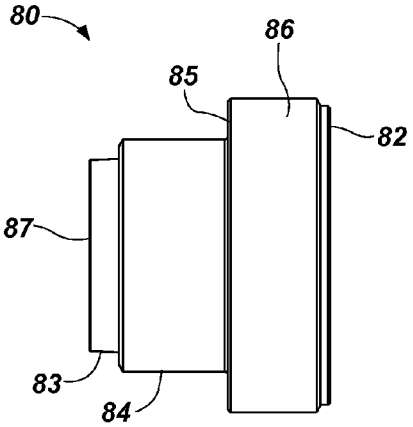
Figure 9A:
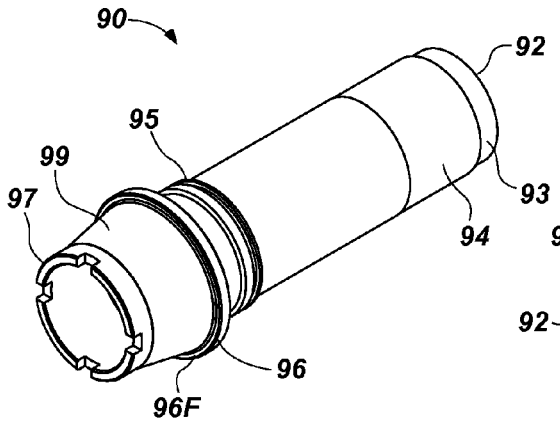
Figure 9B:
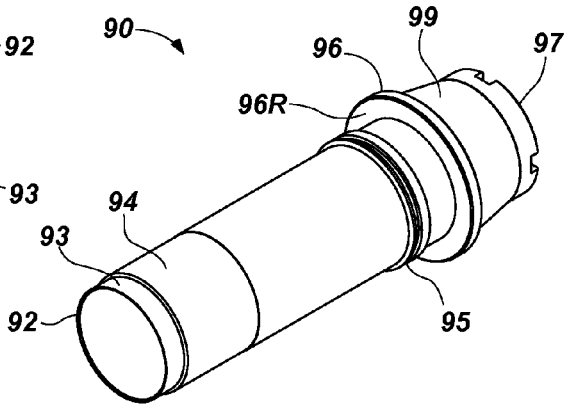
Figure 9C:
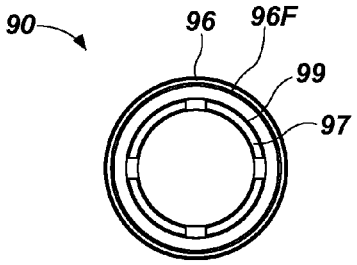
Figure 9D:
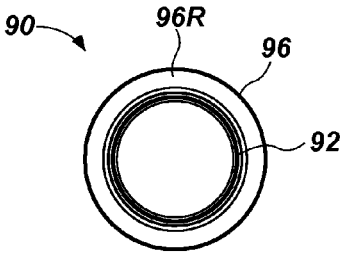
Figure 9E:
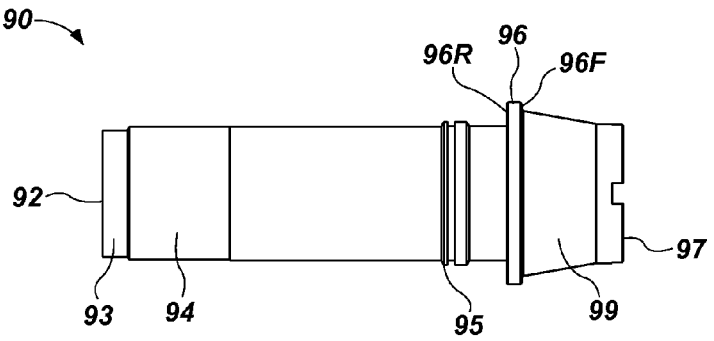
Figure 10A:
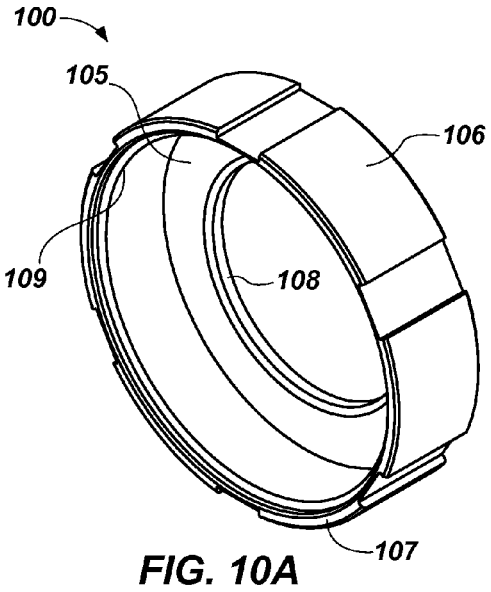
Figure 10B:
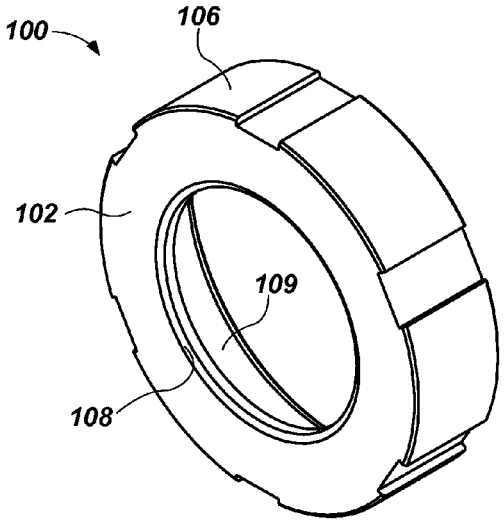
Figure 10C:
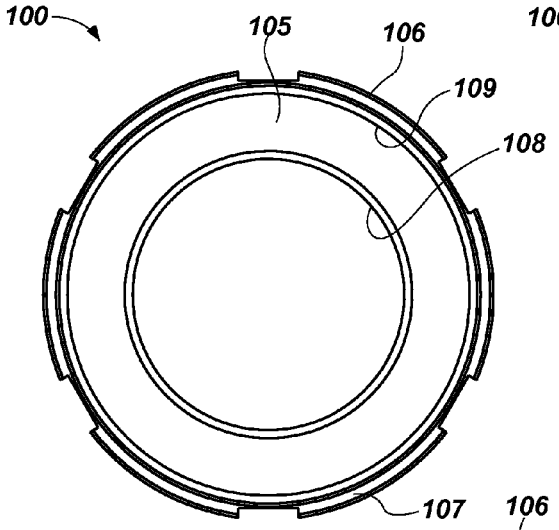
Figure 10D:
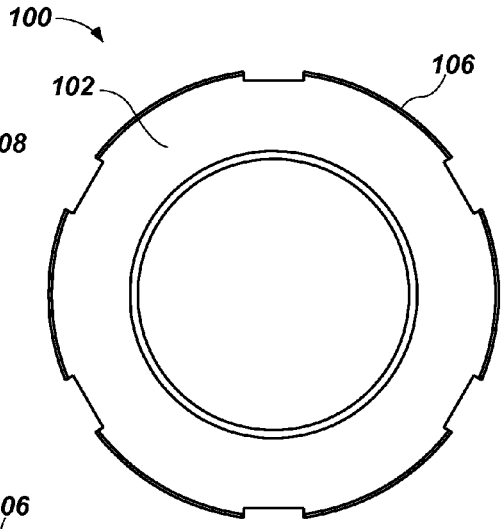
Figure 10E:
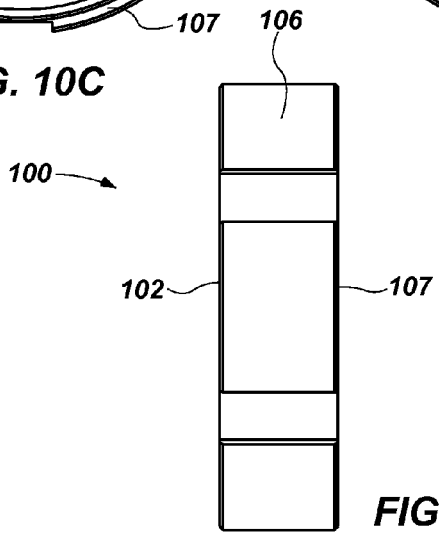

In some embodiments, as illustrated by FIGS. 6A and 6C, at least portions 51 of an interior side, or front-facing side, of the rear end 52 of the rear end cap 50 may have a greater thickness than other portions of the rear end 52 to reinforce those portions 51. In the illustrated embodiment, the portions 51 of the rear end 52 that are reinforced include the locations through which the opening 58 and each coupling aperture 59 are defined. Other locations of the rear end 52 may be thinner to minimize the overall weight of the rear end cap 50 and the sound suppressor 10 (FIG. 1) of which the rear end cap 50 is a part.

The front end 57 of the rear end cap 50 may be open, and configured to receive a rear end 22 (FIGS. 2A through 2H), 42 (FIGS. 5A through 5H) of a baffle unit 20 (FIGS. 4A through 4H), 40 (FIGS. 5A through 5H). A front edge 56F of the spacer 56 of the rear end cap 50, which defines at least a portion of the front end 57, or locations of the spacer 56 adjacent to the front edge 56F, may be configured to engage or to be engaged by corresponding features of or adjacent to the rear end 22, 42 or feature of or adjacent to a rear edge 26R (FIGS. 2A through 2H), 46R (FIGS. 5A through 5H) of a spacer 26 (FIGS. 2A through 2H), 46 (FIGS. 5A through 5H) of an adjacently positioned baffle unit 20, 40.

Referring now to FIGS. 7A through 10E, various elements of an embodiment of a barrel coupling element 60 (FIG. 1) of a sound suppressor 10 (FIG. 1) according to this disclosure are illustrated.

FIGS. 7A through 7E show an embodiment of an inner receiving element 70 of a barrel coupling element 60 (FIG. 1). The inner receiving element 70 comprises an annular member with an outer surface 71 at its outer circumference and a main aperture 78 defined by its inner circumference.

A plurality of guide rod receptacles 72 may be recessed in the outer surface 71 at locations that are spaced apart about the outer circumference of the inner receiving element 70. Each guide rod receptacle 72 may be configured to receive a rear end 132 (FIG. 1) of a corresponding guide rod 130 (FIG. 1).

A periphery of the main aperture 78, i.e., the inner circumference of the inner receiving element 70, may include threads or other engagement features that are configured to interact with corresponding engagement features formed on an exterior (i.e., the outer circumference) of an inner member 84 (FIGS. 8A through 8E) of an outer receiving element 80 (FIG. 1; FIGS. 8A through 8E) of the barrel coupling element 60, enabling the inner receiving element 70 to be secured to the inner member 84 of the outer receiving element 80 in a manner that will hold the outer receiving element 80 in place at the rear end 52 (FIGS. 6A through 6H) of the rear end cap 50 (FIG. 1; FIGS. 6A through 6H).

When FIGS. 6A through 6H are viewed in conjunction with FIGS. 8A through 8E, it can be seen that the inner member 84 of the illustrated embodiment of outer receiving element 80 is configured to be received by the inner portion 581 of the opening 58 that extends through the rear end 52 of the illustrated embodiment of rear end cap 50. As depicted by FIGS. 8A through 8E, in addition to the inner member 84, the outer receiving element 80 of the barrel coupling element 60 (FIG. 1) of a sound suppressor 10 (FIG. 1) may include an outer member 86. The outer member 86 may have an outer diameter that exceeds the outer diameter of the inner member 84. In addition, the outer member 86 may be axially aligned with the inner member 84. Accordingly, a front-facing edge of the outer member 86 may form an annular ledge 85 adjacent to a rear end of the inner member 84. When FIGS. 8A through 8E are viewed in conjunction with FIGS. 6A through 6H, it should be apparent that the outer member 86 of the outer receiving element 80 is configured to be received by the outer portion 580 of the opening 58 through the rear end 52 of the rear end cap 50, and that the annular ledge 85 of the outer receiving element 80 is configured to be positioned against the rearward facing ledge 58L in the opening 58 of the rear end cap 50.

A passage 88 extends through an entire length of the outer receiving element 80, including both its outer member 86 and its inner member 84. At a rear end 82 of the outer member 84 of the outer receiving element 80, an inner diameter of the passage 88 is relatively large, and is configured to readily receive a front end 97 (FIGS. 9A through 9E) and a front portion 99 (FIGS. 9A through 9E) of a choke 90 (FIG. 1; FIGS. 9A through 9E) that is configured to be assembled with (e.g., received by, etc.) the outer receiving element 80. The inner surface of at least a portion of the passage 88 may taper to a smaller diameter at locations that are closer to a front end 87 of the outer receiving element 80. The smaller diameter at such a location may be the same as or smaller than the outer diameter of the front end 97 of the choke 90, which may provide an interference fit between these elements as they are assembled with, forced against and secured to one another. In some embodiments, the passage 88 may include a rearward facing ledge (not labeled), which may be configured to abut, or provide a stop for, the front end 97 of the choke 90. At the front end 87 of the outer receiving element 80, the passage 88 may be configured to focus the projectile(s) (e.g., shot, or BBs, etc.) moving therethrough. The diameter of that portion of the passage 88 may accommodate the projectile (e.g., the wad and the shot, etc.) as it passes therethrough.

The embodiment of choke 90 shown in FIGS. 9A through 9E is an elongated element that includes a rear portion 93 that is configured to be received by and coupled to a barrel of a shotgun or another firearm. In a specific embodiment, the rear portion 93 of the choke 90 may include threads 94 configured to engage complementary threads within the barrel of the firearm. A front end of the rear portion 93 may also be threaded, or includes engagement features 95 (e.g., threads, etc.).

An enlarged annular ridge 96 is located at a front end of the rear portion 93, and defines a boundary between the rear portion 93 and the front portion 99 of the choke 90. As indicated previously herein, the front portion 99 of the choke 90 may be configured for insertion into the rear portion of the passage 88 (FIGS. 8A through 8D) through the outer receiving element 80 (FIGS. 8A through 8E). A front surface 96F of the enlarged annular ridge 96 may be configured to be positioned against the rear end 82 (FIGS. 8B, 8D and 8E) of the outer receiving element 80 and, thus, to limit the distance that the front portion 99 of the choke 90 may be inserted into the rear portion of the passage 88.

In some embodiments, such as that depicted by FIGS. 9A through 9E, the front portion 99 of the choke 90 may be tapered from a larger outer diameter at or near the enlarged annular ridge 96 to a smaller outer diameter at or near the front end 97 of the choke 90.

When the choke 90 is assembled with the barrel of a shotgun or another firearm, a connector 100, such as the annular embodiment depicted by FIGS. 10A through 10E, may be positioned over the rear portion 93 of the choke 90. A rear aperture 108 through a rear end 102 of the connector 100 may have dimensions that enable it to receive the rear portion 93 of the choke 90, but that enable the barrel of the firearm to limit rearward movement of the connector 100 and the enlarged annular ridge 96 to prevent forward movement of the connector 100. In some embodiments, an inner periphery of the rear end 102 of the connector 100, which defines the rear aperture 108, may include threads or one or more other engagement features that are configured to engage one or more corresponding engagement features 95 (FIGS. 9A, 9B and 9E) (e.g., threads and a C-clamp or similar removable stop on a rear side of the threads, etc.) on the rear portion 93 (FIGS. 9A through 9E) of the choke 90 (FIGS. 9A through 9E). These complementary engagement features may enable the connector 100 to be secured in place on the choke 90 when the choke 90 is secured to the barrel of a shotgun or another firearm, but not to the outer receiving element 80 of a sound suppressor 10 (FIG. 1).

A front end 107 of the connector 100 may include a front aperture 109 that is larger (e.g., includes a larger diameter, etc.) than the rear aperture 108. The front aperture 109 may have dimensions that enable it to receive the enlarged annular ridge 96 (FIGS. 9A through 9E) of the choke 90 (FIG. 1; FIGS. 9A through 9E). The dimensions of the front aperture 109 may also enable it to receive the outer member 86 (FIGS. 8A through 8E) of the outer receiving element 80 (FIG. 1; FIGS. 8A through 8E), while engagement features (e.g., threads, locking elements, etc.) on the surface that defines the front aperture 109 may engage complementary engagement features (e.g., threads, locking elements, etc.) on the outer member 86. As the connector 100 engages the outer member 86 of the outer receiving element 80, a front surface 105 of the rear end 102 of the connector 100 may abut a rear surface 96R of the enlarged annular ridge 96 of the choke 90, forcing the front portion 99 of the choke 90 into the rear portion of the passage 88 (FIGS. 8A through 8D) through the outer receiving element 80, creating a seal between these elements and securing them to one another. Such action may thereby enable the sound suppressor 10 (FIG. 1) to be secured to the barrel of the shotgun or other firearm to which the choke 90 has been secured. Conversely, removal of the connector 100 from the outer member 86 of the outer receiving element 80 may enable removal of the sound suppressor 10 from the barrel of the shotgun or other firearm.

With reference now turned to FIGS. 11A through 11H, an embodiment of a front end cap 110 of a sound suppressor 10 (FIG. 1) of this disclosure is depicted. The front end cap 110 includes a spacer 116, a rear end 112 and a front end 117. Like the bodies 21 (FIGS. 2A through 2H), 41 (FIGS. 4A through 4H) of the baffle units 20 (FIG.; FIGS. 3A through 3H), 40 (FIG. 1; FIGS. 4A through 4H), the front end cap 110 may be formed from any suitable material. In a specific embodiment, aluminum may be used to provide structural integrity and durability while minimizing weight and cost.

The rear end 112 of the front end cap 110 is open, and is configured to be positioned against a front end 27 (FIGS. 2A through 2H), 47 (FIGS. 4A through 4H) of a baffle unit 20 (FIG. 1; FIGS. 3A through 3H), 40 (FIG. 1; FIGS. 4A through 4H). In some embodiments, a rear edge 116R of the spacer 116 or locations of the spacer 116 that are adjacent to its rear edge 116R include features that are configured to engage or to be engaged by corresponding features (e.g., tongue-and-groove, recessed edge and corresponding receptacle, etc.) of a baffle unit 20, 40 positioned to the rear end 112 of the front end cap 110.

The front end 117 of the front end cap 110 is substantially closed, with an opening 118 extending therethrough to enable a projectile (e.g., shot and a wad containing the shot, etc.) to be expelled from the sound suppressor 10 (FIG. 1). In some embodiments, the opening 118 may be configured as an aperture through which a projectile will directly pass. In other embodiments, the opening 118 may be configured to receive a front end insert 120 (FIG. 1; FIGS. 12A through 12H) through which a projectile may be expelled.

Additionally, one or more coupling apertures 119 may extend through the front end 117 of the front end cap 110. Each coupling aperture 119 may be configured to receive and at least partially retain a securing element 145 (FIG. 1) that will engage a front end 144 of an elongated coupling element 140 that secures the front end cap 110 to other elements of the sound suppressor 10 (FIG. 1). Each coupling aperture 119 may also be configured to receive the front end 144 of an elongated coupling element 140. In the embodiment of front end cap 110 illustrated by FIGS. 11A through 11D, each coupling aperture 119 includes a counterbore in the front surface of the front end 117.

Figure 11A:
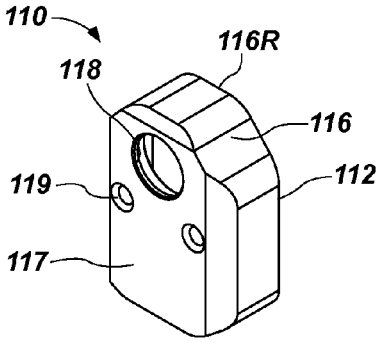
FIGS. 11A through 11H depict an embodiment of a front end cap of the embodiment of sound suppressor illustrated by FIG. 1, with FIG. 11A providing a front isometric view.
Figure 11B:
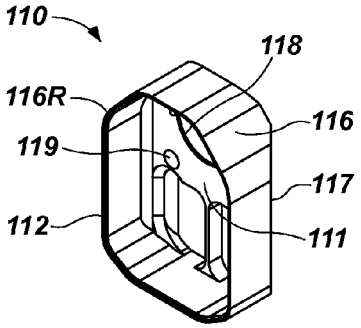
Figure 11C:
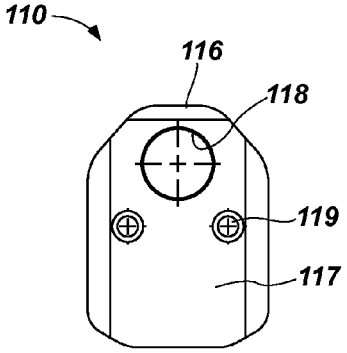
Figure 11D:
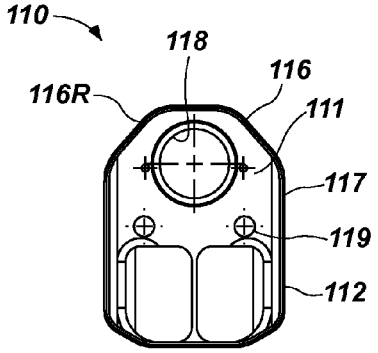
Figure 11E:
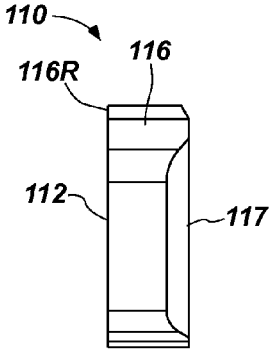
Figure 11F:
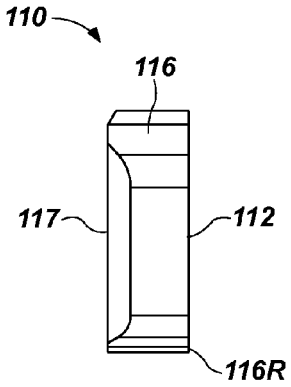
Figure 11G:
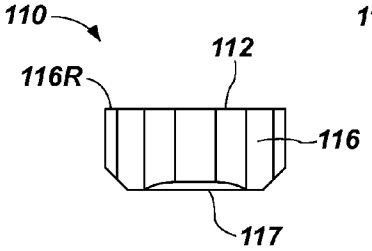
Figure 11H:
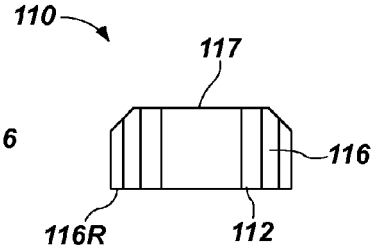

In some embodiments, as illustrated by FIGS. 11A and 11C, at least portions 111 of an interior side, or rear-facing side, of the front end 117 of the front end cap 110 may have a greater thickness than other portions of the front end 117 to reinforce those portions 111. In the illustrated embodiment, the portions 111 of the front end 117 that are reinforced include the locations through which the opening 118 and each coupling aperture 119 are defined. Other locations of the front end 117 may be thinner to minimize the overall weight of the front end cap 110 and the sound suppressor 10 (FIG. 1) of which the front end cap 110 is a part.

An embodiment of a front end insert 120 that may be used with the above-described embodiment of front end cap 110 is illustrated by FIGS. 12A through 12H. The embodiment of front end insert 120 shown in FIGS. 12A through 12H includes a body 121 that is configured to be received by the opening 118 (FIGS. 11A through 11D) through the front end cap 110 (FIG. 1; FIGS. 11A through 11H). The front end insert 120 includes a primary aperture 128 through which a projectile (e.g., shot and a wad that contains the shot, etc.) may pass. Accordingly, the front end insert 120 may comprise a material that will withstand repeated use, as well as occasional impacts by projectiles, such as shot, or BB's, discharged from a shotgun. In a specific embodiment, the front end insert 120 may comprise steel, which is more durable than the aluminum that may be used to define a specific embodiment of the front end cap 110.

In the illustrated embodiment, the front end insert 120 includes a body 121 with a cylindrical configuration, as well as a rear end 122, an opposite front end 127 and flange 126 protruding from a central location of an exterior curved surface of the cylindrical body 121, between the front end 127 and the rear end 122.

Figure 12A:
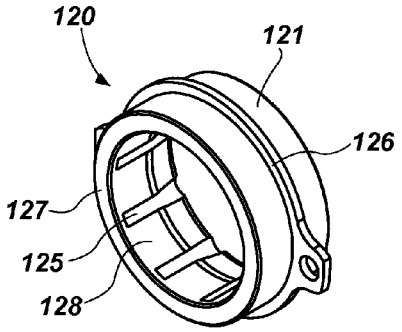
FIGS. 12A through 12H illustrate an embodiment of guide rod retainer of or configured to be carried by the front end cap depicted by FIGS. 11A through 11H, with FIG. 12A providing a front isometric view.
Figure 12B:
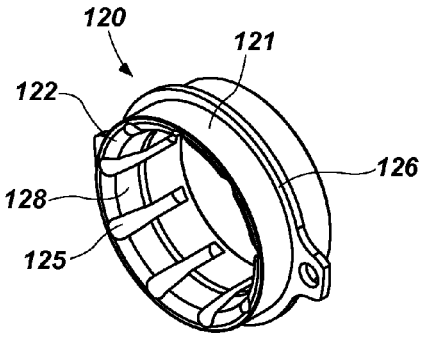
Figure 12C:
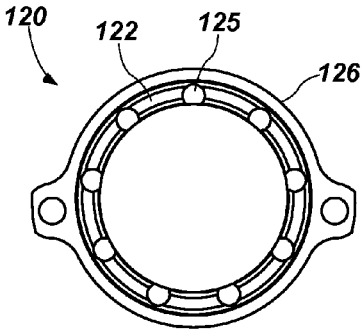
Figure 12D:
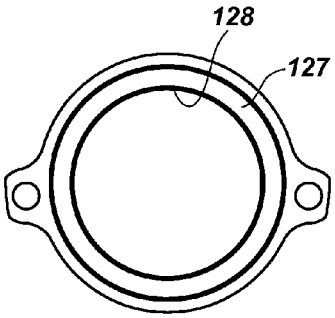
Figure 12E:
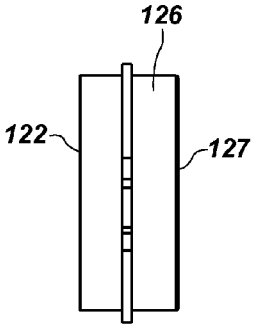
Figure 12F:
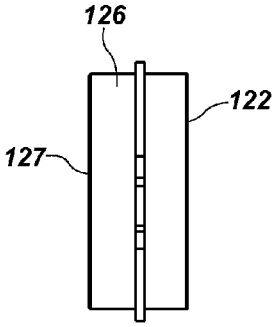
Figure 12G:
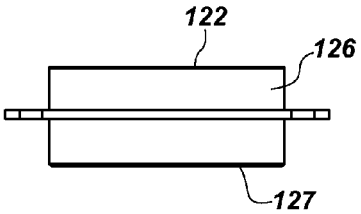
Figure 12H:
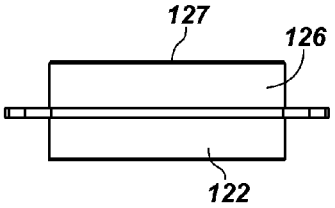

As can be seen in FIGS. 12A through 12C, a plurality of guide rod receptacles 125 may be recessed in the surface of the primary aperture 128. Each guide rod receptacle 125 may open to the rear end 122 of the body 121 of the front end insert 120, but not extend completely to a front edge of the front end 127 of the front end insert 120. Accordingly, while each guide rod receptacle 125 may be configured to receive the front end 134 (FIG. 1) of a guide rod 130 (FIG. 1), each guide rod receptacle 125 may also be configured to limit the forward movement of each guide rod 130.

The front end 127 of the front end insert 120 may be configured for insertion into a rear side of the opening 118 (FIGS. 11A through 11D) through the front end 117 (FIGS. 11A through 11H) of the front end cap 110 (FIGS. 11A through 11H). The flange 126 may be configured to limit insertion of the front end insert 120 into the opening 118 and, in some embodiments, to secure the front end insert 120 to an inner, or rearward facing, surface of the front end 117 of the front end cap 110.

When the elements depicted by FIGS. 1 through 12H are organized into an assembled relationship, the resulting sound suppressor 10 may be configured in the manner illustrated by FIGS. 13A through 13H. In that embodiment, baffle units 20 and 40 are positioned between the rear end cap 50 and the front end cap 110 in an alternating arrangement. Alternatively, two or more open baffle units 40 may be positioned between a pair of constricted baffle units 20. As another alternative, two or more constricted baffle units 20 may be positioned adjacent to one another. In some embodiments, only constricted baffle units 20 may be used.

FIG. 14 provides a cross-sectional representation of the embodiment of assembled sound suppressor 10 depicted by FIGS. 13A through 13H. An interior of the sound suppressor 10 includes a plurality of chambers 12, which are defined between the rear ends 22, 42 of the baffle units 20, 40, respectively.

FIG. 14 also illustrates an embodiment of the arrangement of guide rods 130 through a length of the interior of the sound suppressor 10, with portions of each guide rod 130 along the length thereof being received by a guide rod receptacle 35 recessed in the circumference of each primary aperture 34, the rear end 132 of each guide rod 130 being received by the guide rod receptacles 35, 72 (FIGS. 7A through 7E) in the inner receiving element 70 of the barrel coupling element 60 and the front end 134 of each guide rod 130 being received by the guide rod receptacles 125 in the front end insert 120 for the front end cap 110. When arranged in the manner depicted by FIG. 14, the guide rods 130 define a generally linear tubular pathway through the interior of the sound suppressor 10.

Although the foregoing disclosure provides many specifics, these should not be construed as limiting the scope of any of the appended claims, but merely as providing information pertinent to some specific embodiments that may fall within the scopes of the claims. Other embodiments may be devised which lie within the scopes of the claims. Features from different embodiments may be employed in any combination. All additions, deletions and modifications, as disclosed herein, that fall within the scopes of the claims are to be embraced by the claims.

What is claimed:

1. A sound suppressor for a firearm, comprising:

a plurality of baffles arranged in series;

a plurality of spacers, each spacer of the plurality of spacers separating adjacent baffles of the plurality of baffles apart from one another;

a plurality of chambers, each chamber of the plurality of chambers being defined by adjacent baffles of the plurality of baffles and the spacer separating the adjacent baffles apart from one another;

a plurality of guide rods extending along a length of an interior of the sound suppressor, the plurality of guide rods arranged to define a linear, generally tubular passage through the interior of the sound suppressor, laterally adjacent guide rods of the plurality of guide rods being spaced apart from one another to enable communication of gases from the pathway into the plurality of chambers; wherein the plurality of baffles includes:

at least two constricted baffles including primary apertures with diameters that are about the same as or larger than a diameter across the passage defined by the plurality of guide rods; and at least one open baffle positioned between the at least two constricted baffles, the at least one open baffle including an opening with at least one diameter that exceeds a corresponding diameter of the primary apertures of the at least two constricted baffles.

2. The sound suppressor of claim 1, wherein each guide rod of the plurality of guide rods extends across an entirety of the length of the interior of the sound suppressor.

3. The sound suppressor of claim 1, wherein the plurality of guide rods are arranged to form a framework of a cylinder.

4. The sound suppressor of claim 1, wherein:

the opening of the at least one open baffle comprises a majority of an upper portion of the at least one open baffle.

5. The sound suppressor of claim 1, wherein each baffle of the plurality of baffles and a spacer of the plurality of spacers extending from a front end of that baffle comprise a baffle unit.

6. The sound suppressor of claim 5, wherein a plurality of baffle units are organized in an end-to-end relation to define at least a part of the sound suppressor.

7. The sound suppressor of claim 6, further comprising:

a rear end cap at a rear end of the end-to-end relation of the plurality of baffle units; and a front end cap at a front end of the end-to-end relation of the plurality of baffle units.

8. The sound suppressor of claim 7, further comprising:

at least one elongated coupling element configured to extend through an assembly including the rear end cap, the end-to-end relation of the plurality of baffle units and the front end cap;

a rear securing element configured to engage a rear end of the at least one elongated coupling element through the rear end cap and to hold the rear end of the at least one elongated coupling element in place relative to the rear end cap; and a front securing element configured to engage a front end of the at least one elongated coupling element through the front end cap and to hold the front end of the at least one elongated coupling element in place relative to the front end cap, at least one of the rear securing element and the front securing element configured to compress the assembly to seal adjacent ones of the rear end cap, the plurality of baffle units and the front end cap against one another.

9. The sound suppressor of claim 8, lacking a housing around the assembly.

10. The sound suppressor of claim 1, further comprising:

a barrel coupling element, including:

a choke configured to engage a barrel of a shotgun and to be used with the shotgun with or without other elements of the sound suppressor;

an outer receiving element configured to receive at least a portion of the choke;

an inner receiving element for securing the outer receiving element to a rear end of the sound suppressor; and a connector configured to secure the choke and the outer receiving element to one another.

11. The sound suppressor of claim 10, wherein the connector comprises an annular ridge configured to reside on the choke prior to assembly of the choke with the outer receiving element.

12. The sound suppressor of claim 11, wherein the choke is configured to securely hold the connector in place prior to assembly of the choke with the outer receiving element.

13. A sound suppressor for a firearm, comprising:

a rear end cap configured to receive a projectile from a firearm;

a barrel coupling element associated with the rear end cap;

a front end cap configured to discharge the projectile;

a plurality of baffle units configured to be positioned between the rear end cap and the front end cap, each baffle unit of the plurality of baffle units comprising a baffle and a spacer extending from a front surface of the baffle, a front end of each baffle unit configured to engage a successive baffle unit of the plurality of baffle units or the front end cap, a rear end of each baffle unit configured to be received by the rear end cap or a front end of preceding baffle unit of the plurality of baffle units;

a chamber defined by the baffle of each baffle unit of the plurality of baffle units, the spacer extending forward from that baffle unit and the baffle of the successive baffle unit or the front end cap;

at least one elongate coupling element configured to extend through the plurality of baffle units and at least partially through the rear end cap and the front end cap;

at least one securing element configured to engage or to be engaged by an end of the at least one elongated coupling element and to compressively secure the rear end cap, the plurality of baffle units and the front end cap to one another; wherein the plurality of baffle units comprises:

at least two baffle units with constricted baffles, each constricted baffle including a primary aperture with a diameter that will accommodate a projectile discharged by a firearm with which the sound suppressor is configured to be used, and at least one baffle unit with an open baffle, the at least one baffle unit positioned between the at least two baffle units, the open baffle including an opening with at least one diameter that exceeds a corresponding diameter of the primary aperture of each constricted baffle.

14. The sound suppressor of claim 13, wherein:

the opening of the open baffle of the at least one baffle unit comprises a majority of an upper portion of the open baffle.

15. The sound suppressor of claim 13, lacking a housing around an assembly of the rear end cap, the plurality of baffle units and the front end cap.

16. A method for tailoring a length of a sound suppressor for a firearm, comprising:

selecting a plurality of baffle units with baffles having different configurations to be used with a rear end cap and a front end cap, lengths of the plurality of baffle units, the rear end cap and the front end cap corresponding to a desired length of the sound suppressor;

wherein selecting the plurality of baffle units comprises:

selecting at least two baffle units with constricted baffles, each constricted baffle including a primary aperture with a diameter that will accommodate a projectile discharged by a firearm with which the sound suppressor is configured to be used, and selecting at least one baffle unit with an open baffle, the open baffle including an opening with at least one diameter that exceeds a corresponding diameter of the primary aperture of each constricted baffle;

selecting at least one elongated coupling element having a length corresponding to the desired length of the sound suppressor;

assembling the rear end cap, the plurality of baffle units and the front end cap in an end-to-end arrangement;

introducing the at least one elongated coupling element through a length of the end-to-end arrangement; and securing a securing element to at least one end of the at least one elongated coupling element in a manner that secures the rear end cap, the plurality of baffle units and the front end cap to one another.

17. The method of claim 16, wherein securing comprises securing the securing element in a manner that compressively secures each of the rear end cap, the plurality of baffle units and the front end cap to an adjacent element in a manner that seals joints between each pair of adjacent elements.

18. The method of claim 16, wherein assembling comprises assembling the at least one baffle unit between the at least two baffle units.

19. The method of claim 16, further comprising:

selecting a plurality of guide rods having lengths corresponding to the desired length of the sound suppressor; and assembling the plurality of guide rods with the rear end cap, the plurality of baffle units and the front end cap in a manner that defines a framework of a passage for a projectile through an interior of the sound suppressor.

20. A method for customizing a sound suppressor for a firearm, comprising:

selecting a plurality of baffle units to be used with a rear end cap and a front end cap, including:

selecting at least two baffle units with constricted baffles, each constricted baffle including a primary aperture with a diameter that will accommodate a projectile discharged by a firearm with which the sound suppressor is configured to be used; and selecting at least one baffle unit with an open baffle, the open baffle including an opening with at least one diameter that exceeds a corresponding diameter of the primary aperture of each constricted baffle;

assembling the rear end cap, the plurality of baffle units and the front end cap in an end-to-end arrangement; and securing the rear end cap, the plurality of baffle units and the front end cap in the end-to-end arrangement.

21. The method of claim 20, further comprising:

arranging the at least one baffle unit between the at least two baffle units.

22. The method of claim 20, wherein securing includes:

introducing the at least one elongated coupling element through a length of the end-to-end arrangement; and securing a securing element to at least one end of the at least one elongated coupling element in a manner that secures the rear end cap, the plurality of baffle units and the front end cap to one another.

23. The method of claim 20, further comprising:

assembling a plurality of guide rods with the rear end cap, the plurality of baffle units and the front end cap in a manner that defines a framework of a passage for a projectile through an interior of the sound suppressor.

* * * * *